US007398159B2

(12) United States Patent
Venkataramanan et al.

(10) Patent No.: US 7,398,159 B2
(45) Date of Patent: Jul. 8, 2008

(54) SYSTEM AND METHODS OF DERIVING DIFFERENTIAL FLUID PROPERTIES OF DOWNHOLE FLUIDS

(75) Inventors: Lalitha Venkataramanan, Ridgefield, CT (US); Oliver C. Mullins, Ridgefield, CT (US); Ricardo Reves Vasques, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 36 days.

(21) Appl. No.: 11/207,043

(22) Filed: Aug. 18, 2005

(65) Prior Publication Data

US 2006/0155472 A1 Jul. 13, 2006

Related U.S. Application Data

(63) Continuation-in-part of application No. 11/132,545, filed on May 19, 2005, now Pat. No. 7,305,306.

(60) Provisional application No. 60/642,781, filed on Jan. 11, 2005.

(51) Int. Cl.
*G01V 9/00* (2006.01)

(52) U.S. Cl. ..... 702/11

(58) Field of Classification Search ..... 702/6, 702/9, 11, 12, 13; 73/152.19, 152.24, 152.28, 73/152.42

See application file for complete search history.

(56) References Cited

U.S. PATENT DOCUMENTS

| | | | | |
|---|---|---|---|---|
| 5,939,717 | A | 8/1999 | Mullins | |
| 6,274,865 | B1 | 8/2001 | Schroer et al. | |
| 6,343,507 | B1 | 2/2002 | Felling et al. | |
| 6,350,986 | B1 | 2/2002 | Mullins et al. | |
| 6,476,384 | B1 | 11/2002 | Mullins et al. | |
| 6,714,872 | B2 * | 3/2004 | DiFoggio et al. | 702/12 |
| 6,768,105 | B2 | 7/2004 | Mullins et al. | |
| 6,826,486 | B1 | 11/2004 | Malinverno | 702/16 |
| 6,956,204 | B2 | 10/2005 | Dong et al. | |
| 7,219,541 | B2 * | 5/2007 | DiFoggio | 73/152.17 |
| 2003/0006768 | A1 * | 1/2003 | Kleinberg et al. | 324/303 |
| 2003/0229448 | A1 * | 12/2003 | Storm et al. | 702/6 |
| 2004/0139798 | A1 * | 7/2004 | Haddad et al. | 73/152.42 |
| 2004/0158406 | A1 | 8/2004 | Harrison | |
| 2004/0178336 | A1 * | 9/2004 | DiFoggio | 250/269.1 |

FOREIGN PATENT DOCUMENTS

GB 2 336 912 A 3/1999

OTHER PUBLICATIONS

Mullins, et al., "Real-Time Quantification of OMB Filtrato Contamination During Openhole Wireline Sampling by Optical Spectroscopy", SPWLA 41st Annual Logging Symposium, Jun. 2000, pp. 1-15.

(Continued)

*Primary Examiner*—Donald E McElheny, Jr.
(74) *Attorney, Agent, or Firm*—James McAleenan

(57) ABSTRACT

Methods and systems are provided for downhole analysis of formation fluids by deriving differential fluid properties and associated uncertainty in the predicted fluid properties based on downhole data less sensitive to systematic errors in measurements, and generating answer products of interest based on the differences in the fluid properties. Measured data are used to compute levels of contamination in downhole fluids using, for example, an oil-base mud contamination monitoring (OCM) algorithm. Fluid properties are predicted for the fluids and uncertainties in predicted fluid properties are derived. A statistical framework is provided for comparing the fluids to generate robust, real-time answer products relating to the formation fluids and reservoirs thereof. Systematic errors in measured data are reduced or eliminated by preferred sampling procedures.

27 Claims, 22 Drawing Sheets
(13 of 22 Drawing Sheet(s) Filed in Color)

OTHER PUBLICATIONS

Dong, et al., "Advances in Downhole Contamination Monitoring and GOR Measurement of Formation Fluid Samples", SPWLA 44th Annual Logging Symposium, 2003. pp. 1-12.

Fujisawa, et al., "Large Hydrocarbon Compositional Gradient Revealed by In-Situ Optical Spectroscopy", SPE89704, SPE Annual Technical Conference and Exhibition, 2004, pp. 1-6.

Betancourt et al., "Exploration Applications of Downhole Measurement of Crude Oil Composition and Fluorescence", SPE 87011, SPE Annual Technical Conference and Exhibition, 2004, pp. 1-10.

Mullins, et al., "Compartment Identification by Downhole Fluid Analysis", SPE. 2004, 1-12.

* cited by examiner

SYSTEM AND METHODS OF DERIVING DIFFERENTIAL FLUID PROPERTIES OF DOWNHOLE FLUIDS

RELATED APPLICATION DATA

The present application claims priority under 35 U.S.C. §119 to U.S. Provisional Application Ser. No. 60/642,781 naming L. Venkataramanan et al. as inventors, and filed Jan. 11, 2005; and under 35 U.S.C. §120 as a continuation-in-part of U.S. Non-Provisional application Ser. No. 11/132,545 naming L. Venkataramanan et al. as inventors, and filed May 19, 2005, now U.S. Pat. No. 7,305,306, the aforementioned applications being incorporated herein by reference in their entirety for all purposes.

FIELD OF THE INVENTION

The present invention relates to the analysis of formation fluids for evaluating and testing a geological formation for purposes of exploration and development of hydrocarbon-producing wells, such as oil or gas wells. More particularly, the present invention is directed to system and methods of deriving differential fluid properties of formation fluids from downhole measurements, such as spectroscopy measurements, that are less sensitive to systematic errors in measurement.

BACKGROUND OF THE INVENTION

Downhole fluid analysis (DFA) is an important and efficient investigative technique typically used to ascertain the characteristics and nature of geological formations having hydrocarbon deposits. DFA is used in oilfield exploration and development for determining petrophysical, mine ralogical, and fluid properties of hydrocarbon reservoirs. DFA is a class of reservoir fluid an alysis including composition, fluid properties and phase behavior of the downhole fluids for characterizing hydrocarbon fluids and reservoirs.

Typically, a complex mixture of fluids, such as oil, gas, and water, is found downhole in reservoir formations. The downhole fluids, which are also referred to as formation fluids, have characteristics, including pressure, live fluid color, dead-crude density, gas-oil ratio (GOR), among other fluid properties, that serve as indicators for characterizing hydrocarbon reservoirs. In this, hydrocarbon reservoirs are analyzed and characterized based, in part, on fluid properties of the formation fluids in the reservoirs.

In order to evaluate and test underground formations surrounding a borehole, it is often desirable to obtain samples of formation fluids for purposes of characterizing the fluids. Tools have been developed which allow samples to be taken from a formation in a logging run or during drilling. The Reservoir Formation Tester (RFT) and Modular Formation Dynamics Tester (MDT) tools of Schlumberger are examples of sampling tools for extracting samples of formation fluids for surface analysis.

Recent developments in DFA include techniques for characterizing formation fluids downhole in a wellbore or borehole. In this, Schlumberger's MDT tool may include one or more fluid analysis modules, such as the Composition Fluid Analyzer (CFA) and Live Fluid Analyzer (LFA) of Schlumberger, to analyze downhole fluids sampled by the tool while the fluids are still downhole.

In DFA modules of the type mentioned above, formation fluids that are to be analyzed downhole flow past sensor modules, such as spectrometer modules, which analyze the flowing fluids by near-infrared (NIR) absorption spectroscopy, for example. Co-owned U.S. Pat. Nos. 6,476,384 and 6,768,105 are examples of patents relating to the foregoing techniques, the contents of which are incorporated herein by reference in their entirety. Formation fluids also may be captured in sample chambers associated with the DFA modules, having sensors, such as pressure/temperature gauges, embedded therein for measuring fluid properties of the captured formation fluids.

Downhole measurements, such as optical density of formation fluids utilizing a spectral analyzer, are prone to systematic errors in measurements. These errors may include variations in the measurements with temperature, drift in the electronics leading to biased readings, interference with other effects such as systematic pump-strokes, among other systematic errors in measurements. Such errors have pronounced affect on fluid characterizations obtained from the measured data. These systematic errors are hard to characterize a priori with tool calibration.

SUMMARY OF THE INVENTION

In consequence of the background discussed above, and other factors that are known in the field of downhole fluid analysis, applicants discovered methods and systems for real-time analysis of formation fluids by deriving differential fluid properties of the fluids and answer products of interest based on differential fluid properties that are less sensitive to systematic errors in measured data.

In preferred embodiments of the invention, data from downhole measurements, such as spectroscopic data, having reduced errors in measurements are used to compute levels of contamination. An oil-base mud contamination monitoring (OCM) algorithm may be used to determine contamination levels, for example, from oil-base mud (OBM) filtrate, in downhole fluids. Fluid properties, such as live fluid color, dead-crude density, gas-oil ratio (GOR), fluorescence, among others, are predicted for the downhole fluids based on the predicted levels of contamination. Uncertainties in fluid properties are derived from uncertainty in measured data and uncertainty in predicted contamination. A statistical framework is provided for comparison of the fluids to generate real-time, robust answer products relating to the formation fluids and reservoirs.

Applicants developed modeling methodology and systems that enable real-time DFA by comparison of fluid properties. For example, in preferred embodiments of the invention, modeling techniques and systems are used to process fluid analysis data, such as spectroscopic data, relating to downhole fluid sampling and to compare two or more fluids for purposes of deriving analytical results based on comparative properties of the fluids.

Applicants recognized that reducing or eliminating systematic errors in measured data, by use of novel sampling and downhole analysis procedures of the present invention, would lead to robust and accurate comparisons of formation fluids based on predicted fluid properties with reduced errors in downhole data measurements.

Applicants also recognized that quantifying levels of contamination in formation fluids and determining uncertainties associated with the quantified levels of contamination for the fluids would be advantageous steps toward deriving answer products of interest in oilfield exploration and development.

Applicants also recognized that uncertainty in measured data and in quantified levels of contamination could be propagated to corresponding uncertainties in other fluid properties of interest, such as live fluid color, dead-crude density, gas-oil ratio (GOR), fluorescence, among others.

Applicants further recognized that quantifying uncertainty in predicted fluid properties of formation fluids would provide an advantageous basis for real-time comparison of the fluids, and is less sensitive to systematic errors in the data.

In accordance with the invention, one method of deriving fluid properties of downhole fluids and providing answer products from downhole spectroscopy data measurements includes acquiring at least a first fluid and a second fluid and, at substantially the same downhole conditions, analyzing the first and second fluid with a device in a borehole to generate fluid property data for the first and second fluid. In one embodiment of the invention, the method further comprises deriving respective fluid properties of the fluids based on the fluid property data for the first and second fluid; quantifying uncertainty in the derived fluid properties; and comparing the fluids based on the derived fluid properties and uncertainty in fluid properties.

The derived fluid properties may be one or more of live fluid color, dead crude density, GOR and fluorescence. In one embodiment of the invention, the method may include providing answer products comprising sampling optimization by the borehole device based on the respective fluid properties derived for the fluids. In another embodiment of the invention, the fluid property data comprise optical density from one or more spectroscopic channels of the device in the borehole and the method further comprises receiving uncertainty data with respect to the optical density data.

In yet another embodiment, the method may include locating the device in the borehole at a position based on a fluid property of the fluids. Another embodiment of the invention may include quantifying a level of contamination and uncertainty thereof for each of the two fluids. Yet other embodiments of the invention may include providing answer products, based on the fluid property data, relating to one or more of compartmentalization, composition gradients and optimal sampling process with respect to evaluation and testing of a geologic formation.

One method of the present invention includes decoloring the fluid property data; determining respective compositions of the fluids; deriving volume fraction of light hydrocarbons for each of the fluids; and providing formation volume factor for each of the fluids.

The fluid property data for each fluid may be received from a methane channel and a color channel of a downhole spectral analyzer. Other embodiments of the invention may include quantifying a level of contamination and uncertainty thereof for each of the channels for each fluid; obtaining a linear combination of the levels of contamination for the channels and uncertainty with respect to the combined level of contamination for each fluid; determining composition of each fluid; predicting GOR for each fluid based upon the corresponding composition of each fluid and the combined level of contamination; and deriving uncertainty associated with the predicted GOR of each fluid. The fluids may be compared based on the predicted GOR and derived uncertainty of each fluid. In one aspect of the invention, comparing the fluids comprises determining probability that the fluids are different.

One method of the invention may include acquiring at least one of the first and the second fluid from an earth formation traversed by the borehole. Another aspect of the invention may include acquiring at least one of the first and the second fluid from a first source and another one of the first and second fluid from a different second source. The first and second source may comprise different locations of an earth formation traversed by the borehole. At least one of the first and second source may comprise a stored fluid. The first and second source may comprise fluids acquired at different times at a same location of an earth formation traversed by the borehole.

In yet another embodiment of the invention, a method of reducing systematic errors in downhole data comprises acquiring downhole data sequentially for at least a first and a second fluid at substantially the same downhole conditions with a device in a borehole.

Yet another embodiment of the invention provides a downhole fluid characterization apparatus having a fluid analysis module; a flowline for fluids withdrawn from a formation to flow through the fluid analysis module; a selectively operable device structured and arranged with respect to the flowline for alternately flowing at least a first and a second fluid through the fluid analysis module; and at least one sensor associated with the fluid analysis module for generating fluid property data for the first and second fluid at substantially the same downhole conditions. In one embodiment of the invention, the selectively operable device comprises at least one valve associated with the flowline. The valve may include one or more of check valves in a pumpout module and a borehole output valve associated with the flowline. In one aspect of the invention, the selectively operable device comprises a device with multiple storage containers for selectively storing and discharging fluids withdrawn from the formation.

In yet another aspect of the invention, a system for characterizing formation fluids and providing answer products based upon the characterization comprises a borehole tool having a flowline with at least one sensor for sensing at least one parameter of fluids in the flowline; and a selectively operable device associated with the flowline for flowing at least a first and a second fluid through the flowline so as to be in communication with the sensor, wherein the sensor generates fluid property data with respect to the first and second fluid with the first and second fluid at substantially the same downhole conditions. At least one processor, coupled to the borehole tool, may include means for receiving fluid property data from the sensor and the processor may be configured to derive respective fluid properties of the first and second fluid based on the fluid property data.

In other aspects of the invention, a computer usable medium having computer readable program code thereon, which when executed by a computer, adapted for use with a borehole system for characterizing downhole fluids, comprises receiving fluid property data for at least at first and a second downhole fluid, wherein the fluid property data of the first and second fluid are generated with a device in a borehole with the first and second fluid at substantially the same downhole conditions; and calculating respective fluid properties of the fluids based on the received data.

Additional advantages and novel features of the invention will be set forth in the description which follows or may be learned by those skilled in the art through reading the materials herein or practicing the invention. The advantages of the invention may be achieved through the means recited in the attached claims.

BRIEF DESCRIPTION OF THE DRAWINGS

The patent or application file contains at least one drawing executed in color. Copies of this patent or patent application publication with color drawings will be provided by the Office upon request and payment of the necessary fee.

The accompanying drawings illustrate preferred embodiments of the present invention and are a part of the specification. Together with the following description, the drawings demonstrate and explain principles of the present invention.

Figure 1:
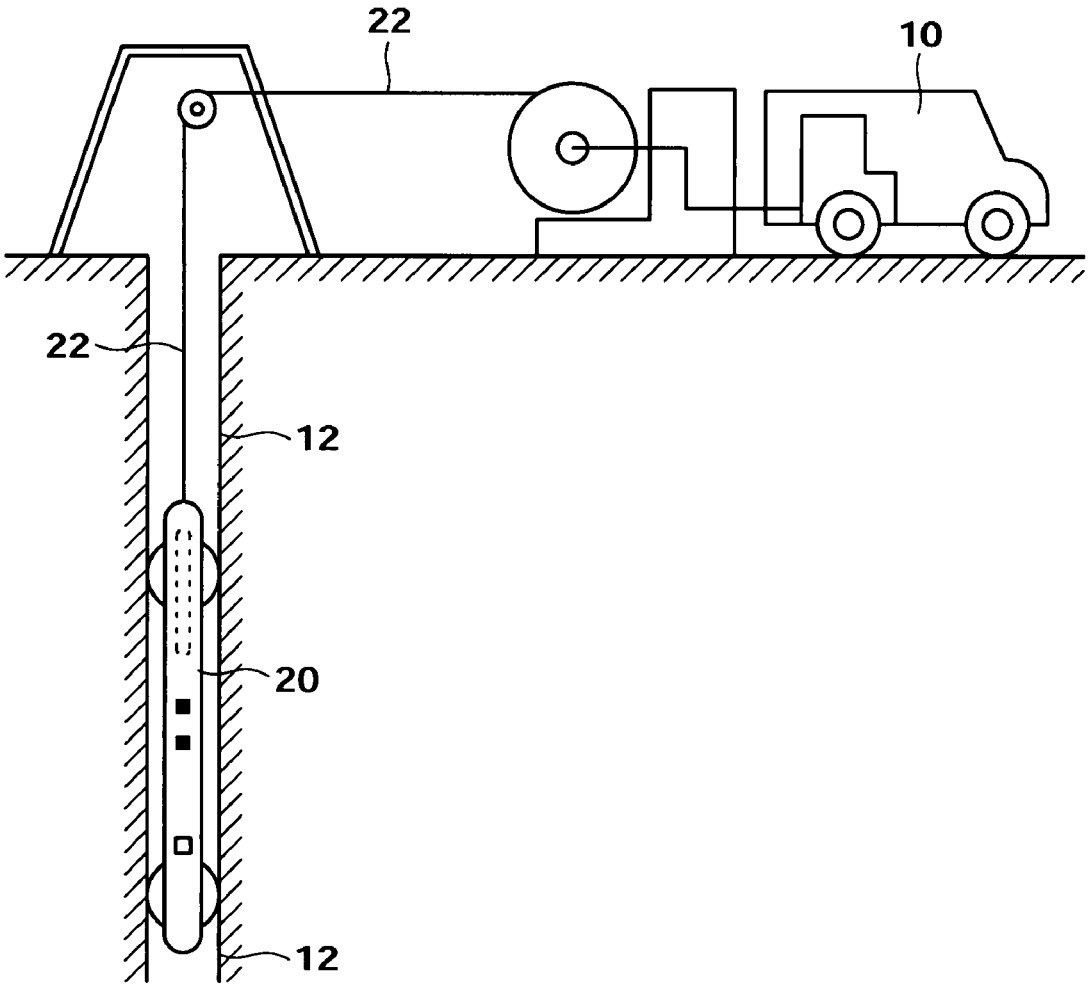
FIG. 1 is a schematic representation in cross-section of an exemplary operating environment of the present invention.

Throughout the drawings, identical reference numbers indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF PREFERRED EMBODIMENTS

Illustrative embodiments and aspects of the invention are described below. In the interest of clarity, not all features of an actual implementation are described in the specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having benefit of the disclosure herein.

The present invention is applicable to oilfield exploration and development in areas such as wireline and logging-while-drilling (LWD) downhole fluid analysis using fluid analysis modules, such as Schlumberger's Composition Fluid Analyzer (CFA) and/or Live Fluid Analyzer (LFA) modules, in a formation tester tool, for example, the Modular Formation Dynamics Tester (MDT). As used herein, the term "real-time" refers to data processing and analysis that are substantially simultaneous with acquiring a part or all of the data, such as while a borehole apparatus is in a well or at a well site engaged in logging or drilling operations; the term "answer product" refers to intermediate and/or end products of interest with respect to oilfield exploration, development and production, which are derived from or acquired by processing and/or analyzing downhole fluid data; the term "compartmentalization" refers to lithological barriers to fluid flow that prevent a hydrocarbon reservoir from being treated as a single producing unit; the terms "contamination" and "contaminants" refer to undesired fluids, such as oil-base mud filtrate, obtained while sampling for reservoir fluids; and the term "uncertainty" refers to an estimated amount or percentage by which an observed or calculated value may differ from the true value.

Applicants' understanding of compartmentalization in hydrocarbon reservoirs provides a basis for the present invention. Typically, pressure communication between layers in a formation is a measure used to identify compartmentalization. However, pressure communication does not necessarily translate into flow communication between layers and, an assumption that it does, can lead to missing flow compartmentalization. It has recently been established that pressure measurements are insufficient in estimating reservoir compartmentalization and composition gradients. Since pressure communication takes place over geological ages, it is possible for two disperse sand bodies to be in pressure communication, but not necessarily in flow communication with each other.

Applicants recognized that a fallacy in identifying compartmentalization can result in significant errors being made in production parameters such as drainage volume, flow rates, well placement, sizing of facilities and completion equipment, and errors in production prediction. Applicants also recognized a current need for applications of robust and accurate modeling techniques and novel sampling procedures to the identification of compartmentalization and composition gradients, and other characteristics of interest in hydrocarbon reservoirs.

Currently decisions about compartmentalization and/or composition gradients are derived from a direct comparison of fluid properties, such as the gas-oil ratio (GOR), between two neighboring zones in a formation. Evaluative decisions, such as possible GOR inversion or density inversion, which are markers for compartmentalization, are made based on the direct comparison of fluid properties. Applicants recognized that such methods are appropriate when two neighboring zones have a marked difference in fluid properties, but a direct comparison of fluid properties from nearby zones in a formation is less satisfactory when the fluids therein have varying levels of contamination and the difference between fluid properties is small, yet significant in analyzing the reservoir.

Applicants further recognized that often, in certain geological settings, the fluid density inversions may be small and projected over small vertical distances. In settings where the density inversion, or equivalently the GOR gradient, is small, current analysis could misidentify a compartmentalized reservoir as a single flow unit with expensive production consequences as a result of the misidentification. Similarly, inaccurate assessments of spatial variations of fluid properties may be propagated into significant inaccuracies in predictions with respect to formation fluid production.

In view of the forgoing, applicants understood that it is critical to ascertain and quantify small differences in fluid properties between adjacent layers in a geological formation bearing hydrocarbon deposits. Additionally, once a reservoir has started production it is often essential to monitor hydrocarbon recovery from sectors, such as layers, fault blocks, etc., within the reservoir. Key data for accurately monitoring hydrocarbon recovery are the hydrocarbon compositions and properties, such as optical properties, and the differences in the fluid compositions and properties, for different sectors of the oilfield.

In consequence of applicants' understanding of the factors discussed herein, the present invention provides systems and methods of comparing downhole fluids using robust statistical frameworks, which compare fluid properties of two or more fluids having same or different fluid properties, for example, same or different levels of contamination by mud filtrates. In this, the present invention provides systems and methods for comparing downhole fluids using cost-effective and efficient statistical analysis tools. Real-time statistical comparisons of fluid properties that are predicted for the downhole fluids are done with a view to characterizing hydrocarbon reservoirs, such as by identifying compartmentalization and/or composition gradients in the reservoirs. Applicants recognized that fluid properties, for example, GOR, fluid density, as functions of measured depth provide advantageous markers for reservoir characteristics. For example, if the derivative of GOR as a function of depth is step-like, i.e., not continuous, compartmentalization in the reservoir is likely. Similarly, other fluid properties may be utilized as indicators of compartmentalization and/or composition gradients.

In one aspect of the invention, downhole measurements, such as spectroscopic data from a downhole tool, such as the MDT, are used to compare two fluids having the same or different levels of mud filtrate contamination. In another aspect of the invention, downhole fluids are compared by quantifying uncertainty in various predicted fluid properties.

The systems and methods of the present invention use the concept of mud filtrate fraction decreasing asymptotically over time. The present invention, in preferred embodiments, uses coloration measurement of optical density and near-infrared (NIR) measurement of gas-oil ratio (GOR) spectroscopic data for deriving levels of contamination at two or more spectroscopic channels with respect to the fluids being sampled. These methods are discussed in more detail in the following patents, each of which is incorporated herein by reference in its entirety: U.S. Pat. Nos. 5,939,717; 6,274,865; and 6,350,986.

The techniques of the present invention provide robust statistical frameworks to compare fluid properties of two or more fluids with same or different levels of contamination. For example, two fluids, labeled A and B, may be obtained from Stations A and B, respectively. Fluid properties of the fluids, such as live fluid color, dead-crude density, fluorescence and gas-oil ratio (GOR), may be predicted for both fluids based on measured data. Uncertainty in fluid properties may be computed from uncertainty in the measured data and uncertainty in contamination, which is derived for the fluids from the measured data. Both random and systematic errors contribute to the uncertainty in the measured data, such as optical density, which is obtained, for example, by a downhole fluid analysis module or modules. Once the fluid properties and their associated uncertainties are quantified, the properties are compared in a statistical framework. The differential fluid properties of the fluids are obtained from the difference of the corresponding fluid properties of the two fluids. Uncertainty in quantification of differential fluid properties reflects both random and systematic errors in the measurements, and may be quite large.

Applicants discovered novel and advantageous fluid sampling and downhole analysis procedures that allow data acquisition, sampling and data analysis corresponding to two or more fluids so that differential fluid properties are less sensitive to systematic errors in the measurements. In conventional downhole sampling procedures, formation fluids analyzed or sampled at a first station are not trapped and taken to a next station. In consequence, computations of uncertainty in differential fluid properties reflect both the random and systematic errors in the measured data, and can be significantly large.

In contrast, with the preferred sampling methods of the present invention, systematic errors in measurements are minimized. Consequently, the derived differences in fluid properties are more robust and accurately reflect the differential fluid properties.

FIG. 1 is a schematic representation in cross-section of an exemplary operating environment of the present invention. Although FIG. 1 depicts a land-based operating environment, the present invention is not limited to land and has applicability to water-based applications, including deepwater development of oil reservoirs. Furthermore, although the description herein uses an oil and gas exploration and production setting, it is contemplated that the present invention has applicability in other settings, such as underground water reservoirs.

In FIG. 1, a service vehicle 10 is situated at a well site having a borehole 12 with a borehole tool 20 suspended therein at the end of a wireline 22. In this, it is also contemplated that techniques and systems of the present invention are applicable in LWD procedures. Typically, the borehole 12 contains a combination of fluids such as water, mud, formation fluids, etc. The borehole tool 20 and wireline 22 typically are structured and arranged with respect to the service vehicle 10 as shown schematically in FIG. 1, in an exemplary arrangement.

Figure 2:
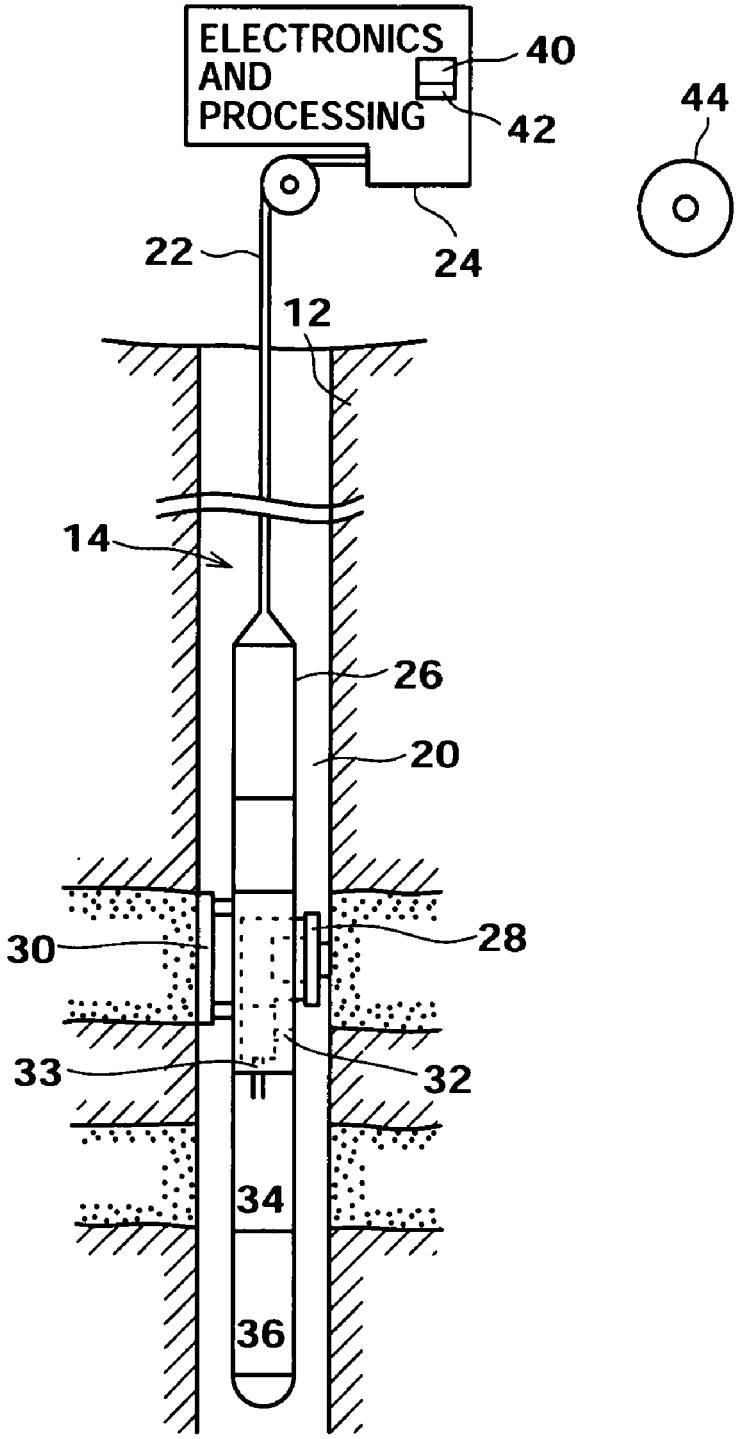
FIG. 2 is a schematic representation of one system for comparing formation fluids according to the present invention.

FIG. 2 discloses one exemplary system 14 in accordance with the present invention for comparing downhole fluids and generating analytical products based on the comparative fluid properties, for example, while the service vehicle 10 is situated at a well site (note FIG. 1). The borehole system 14 includes a borehole tool 20 for testing earth formations and analyzing the composition of fluids that are extracted from a formation and/or borehole. In a land setting of the type depicted in FIG. 1, the borehole tool 20 typically is suspended in the borehole 12 (note FIG. 1) from the lower end of a multiconductor logging cable or wireline 22 spooled on a winch (note again FIG. 1) at the formation surface. In a typical system, the logging cable 22 is electrically coupled to a surface electrical control system 24 having appropriate electronics and processing systems for control of the borehole tool 20.

Figure 3:
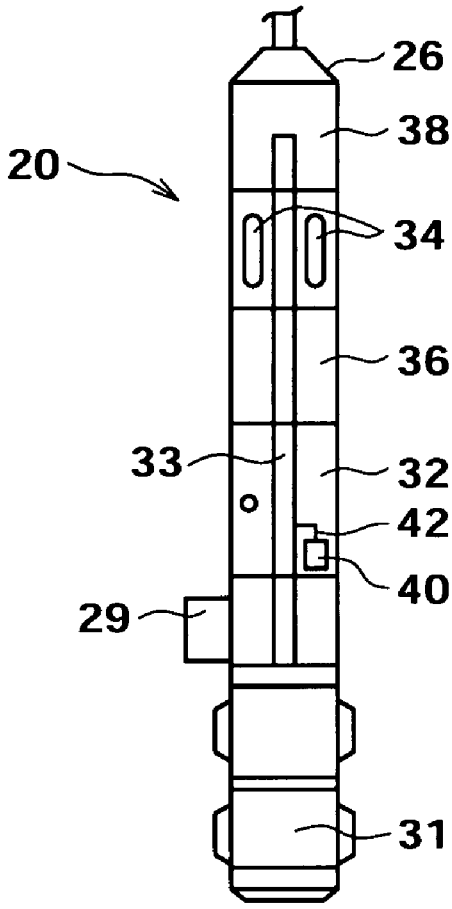
FIG. 3 is a schematic representation of one fluid analysis module apparatus for comparing formation fluids according to the present invention.

Referring also to FIG. 3, the borehole tool 20 includes an elongated body 26 encasing a variety of electronic components and modules, which are schematically represented in FIGS. 2 and 3, for providing necessary and desirable functionality to the borehole tool string 20. A selectively extendible fluid admitting assembly 28 and a selectively extendible tool-anchoring member 30 (note FIG. 2) are respectively arranged on opposite sides of the elongated body 26. Fluid admitting assembly 28 is operable for selectively sealing off or isolating selected portions of a borehole wall 12 such that pressure or fluid communication with adjacent earth formation is established. In this, the fluid admitting assembly 28 may be a single probe module 29 (depicted in FIG. 3) and/or a packer module 31 (also schematically represented in FIG. 3).

One or more fluid analysis modules 32 are provided in the tool body 26. Fluids obtained from a formation and/or borehole flow through a flowline 33, via the fluid analysis module or modules 32, and then may be discharged through a port of a pumpout module 38 (note FIG. 3). Alternatively, formation fluids in the flowline 33 may be directed to one or more fluid collecting chambers 34 and 36, such as 1, 2¾, or 6 gallon sample chambers and/or six 450 cc multi-sample modules, for receiving and retaining the fluids obtained from the formation for transportation to the surface.

The fluid admitting assemblies, one or more fluid analysis modules, the flow path and the collecting chambers, and other operational elements of the borehole tool string 20, are controlled by electrical control systems, such as the surface electrical control system 24 (note FIG. 2). Preferably, the electrical control system 24, and other control systems situated in the tool body 26, for example, include processor capability for deriving fluid properties, comparing fluids, and executing other desirable or necessary functions with respect to formation fluids in the tool 20, as described in more detail below.

The system 14 of the present invention, in its various embodiments, preferably includes a control processor 40 operatively connected with the borehole tool string 20. The control processor 40 is depicted in FIG. 2 as an element of the electrical control system 24. Preferably, the methods of the present invention are embodied in a computer program that runs in the processor 40 located, for example, in the control system 24. In operation, the program is coupled to receive data, for example, from the fluid analysis module 32, via the wireline cable 22, and to transmit control signals to operative elements of the borehole tool string 20.

The computer program may be stored on a computer usable storage medium 42 associated with the processor 40, or may be stored on an external computer usable storage medium 44 and electronically coupled to processor 40 for use as needed. The storage medium 44 may be any one or more of presently known storage media, such as a magnetic disk fitting into a disk drive, or an optically readable CD-ROM, or a readable device of any other kind, including a remote storage device coupled over a switched telecommunication link, or future storage media suitable for the purposes and objectives described herein.

In preferred embodiments of the present invention, the methods and apparatus disclosed herein may be embodied in one or more fluid analysis modules of Schlumberger's formation tester tool, the Modular Formation Dynamics Tester (MDT). The present invention advantageously provides a formation tester tool, such as the MDT, with enhanced functionality for downhole analysis and collection of formation fluid samples. In this, the formation tester tool may advantageously be used for sampling formation fluids in conjunction with downhole fluid analysis.

Applicants recognized the potential value, in downhole fluid analysis, of an algorithmic approach to comparing two or more fluids having either different or the same levels of contamination.

In a preferred embodiment of one method of the present invention, a level of contamination and its associated uncertainty are quantified in two or more fluids based on spectroscopic data acquired, at least in part, from a fluid analysis module 32 of a borehole apparatus 20, as exemplarily shown in FIGS. 2 and 3. Uncertainty in spectroscopic measurements, such as optical density, and uncertainty in predicted contamination are propagated to uncertainties in fluid properties, such as live fluid color, dead-crude density, gas-oil ratio (GOR) and fluorescence. The target fluids are compared with respect to the predicted properties in real-time.

Answer products of the invention are derived from the predicted fluid properties and the differences acquired thereof. In one aspect, answer products of interest may be derived directly from the predicted fluid properties, such as formation volume factor (BO), dead crude density, among others, and their uncertainties. In another aspect, answer products of interest may be derived from differences in the predicted fluid properties, in particular, in instances where the predicted fluid properties are computationally close, and the uncertainties in the calculated differences. In yet another aspect, answer products of interest may provide inferences or markers with respect to target formation fluids and/or reservoirs based on the calculated differences in fluid properties, i.e., likelihood of compartmentalization and/or composition gradients derived from the comparative fluid properties and uncertainties thereof.

Figure 4:
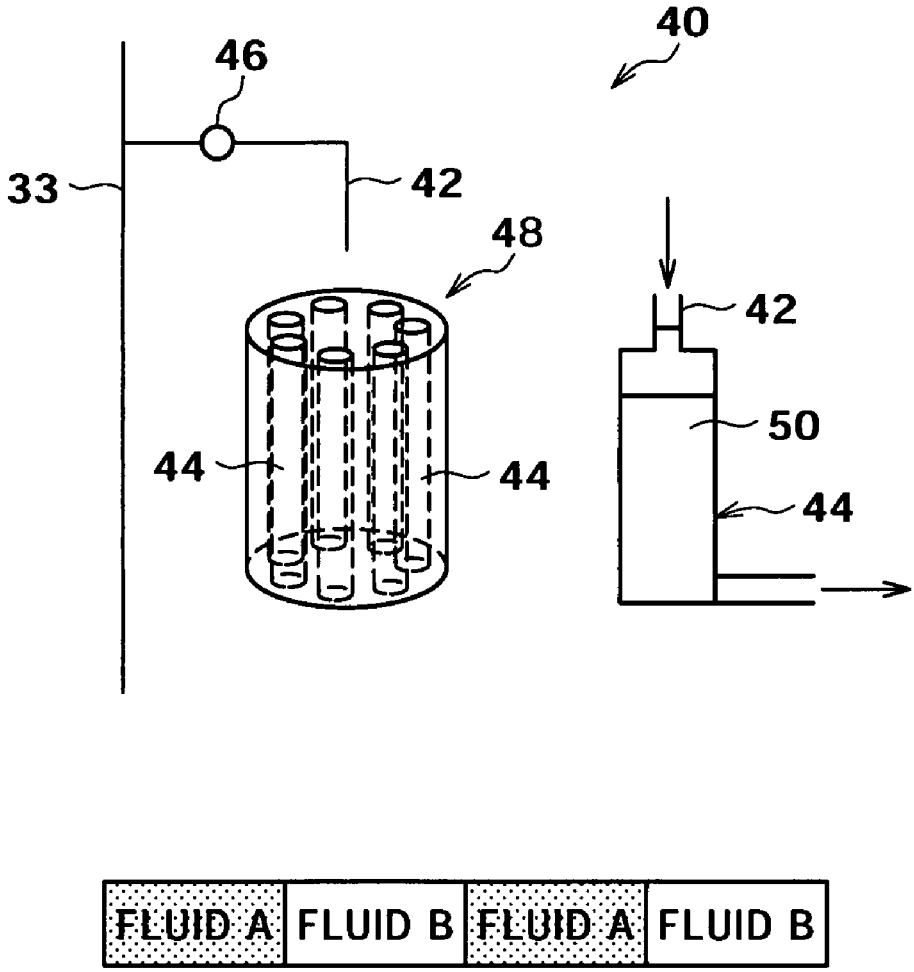
FIG. 4 is a schematic depiction of a fluid sampling chamber according to one embodiment of the present invention for capturing or trapping formation fluids in a fluid analysis module apparatus.

FIG. 4 is a schematic depiction of a trapping chamber 40 for trapping and holding samples of formation fluids in the borehole tool 20. The chamber 40 may be connected with the flowline 33 via a line 42 and check valve 46. The chamber 40 includes one or more bottle 44. If a plurality of bottles 44 are provided, the bottles 44 may be structured and arranged as a rotatable cylinder 48 so that each bottle may be sequentially aligned with the line 42 to receive formation fluids for trapping and holding in the aligned bottle. For example, when formation fluids flowing through the flowline 33 reach acceptable contamination levels after clean up, the check valve 46 may be opened and formation fluids may be collected in one of the bottles 44 that is aligned with the line 42. The trapped fluids then may be discharged from the chamber 40 to run or flow past one or more spectroscopy modules and be directed into another sample chamber (not shown) that is placed beyond the spectroscopy modules.

Analysis of the formation fluids may be done at different times during the downhole sampling/analysis process. For example, after formation fluids from two stations have been collected, the fluids may be flowed past spectral analyzers one after the other. As another embodiment, fluids at the same location of the apparatus 20 in the borehole 12 (note FIG. 2) may be collected or trapped at different times to acquire two or more samples of formation fluids for analysis with the fluid analysis module or modules 32, as described in further detail below. In this, the present invention contemplates various and diverse methods and techniques for collecting and trapping fluids for purposes of fluid characterization as described herein. It is contemplated that various situations and contexts may arise wherein it is necessary and/or desirable to analyze and compare two or more fluids at substantially the same downhole conditions using one or more fluid analysis modules. For example, it may be advantageous to let a fluid sample or samples settle for a period of time, to allow gravity separation, for example, of fines or separated phases in the fluids, before analyzing two or more fluids at substantially the same downhole conditions to obtain fluid property data with less errors due to measurement errors. As other possibilities, it may be advantageous to vary pressure and volume of fluids by a pressure and volume control unit, for example, or to determine pressure-volume characteristics of two or more fluids at substantially the same downhole conditions. These methods are discussed in more detail in co-pending and commonly owned U.S. patent application Ser. No. 11/203,932, titled "Methods and Apparatus of Downhole Fluid Analysis", naming T. Terabayashi et al. as inventors, filed Aug. 15, 2005, which is incorporated herein by reference in its entirety. Such variations and adaptations in acquiring downhole fluids and in analyzing the fluids for purposes of the invention described herein are within the scope of the present invention.

Optical densities of the acquired fluids and the derived answer products may be compared and robust predictions of differential fluid properties derived from the measured data. In this, two or more fluids, for example, fluids A and B, may flow past spectral analyzers alternately and repeatedly so that substantially concurrent data are obtained for the two fluids. FIG. 4 shows a schematic representation of an alternating flow of fluids past a sensor for sensing a parameter of the fluids. Other flow regimes also are contemplated by the present invention.

In another embodiment of the present invention, appropriately sized sample bottles may be provided for downhole fluid comparison. The multiple sample bottles may be filled at different stations using techniques that are known in the art. In addition, formation fluids whose pressure-volume-temperature (PVT) properties are to be determined also may be collected in other, for example, larger bottles, for further PVT analysis at a surface laboratory, for example. In such embodiments of the invention, different formation fluids, i.e., fluids collected at different stations, times, etc., may be compared subsequently by flowing the fluids past spectral analyzers or other sensors for sensing parameters of the fluids. After analysis, the formation fluids may be pumped back into the borehole or collected in other sample bottles or handled as desirable or necessary.

FIG. 4 shows one possible embodiment of the chamber 40 for fluid comparison according to one embodiment of the present invention. Appropriately sized bottles 44 may be incorporated in a revolving cylinder 48. The cylinder 48 may be structured and arranged for fluid communication with the flowline 33 via a vertical displacement thereof such that line 42 from the flowline 33 connects with a specific bottle 44. The connected bottle 44 then can be filled with formation fluids, for example, by displacing an inner piston 50. The trapped fluids may later be used for fluid comparison according to the present invention. In this, formation fluids from several different depths of a borehole may be compared by selecting specific bottles of the chamber 40. Check valve 46 may be provided to prevent fluid leak once the flowline 33 has been disconnected from the chamber 40 whereas when the chamber 40 is connected with the flowline 33 the check valve 46 allows fluid flow in both directions.

FIGS. 5(A) to 5(E) represent in flowcharts preferred methods according to the present invention for comparing downhole fluids and generating answer products based on the comparative results. For purposes of brevity, a description herein will primarily be directed to contamination from oil-base mud (OBM) filtrate. However, the systems and methods of the present invention are readily applicable to water-base mud (WBM) or synthetic oil-base mud (SBM) filtrates as well.

Quantification of Contamination and its Uncertainty

Figure 5A:
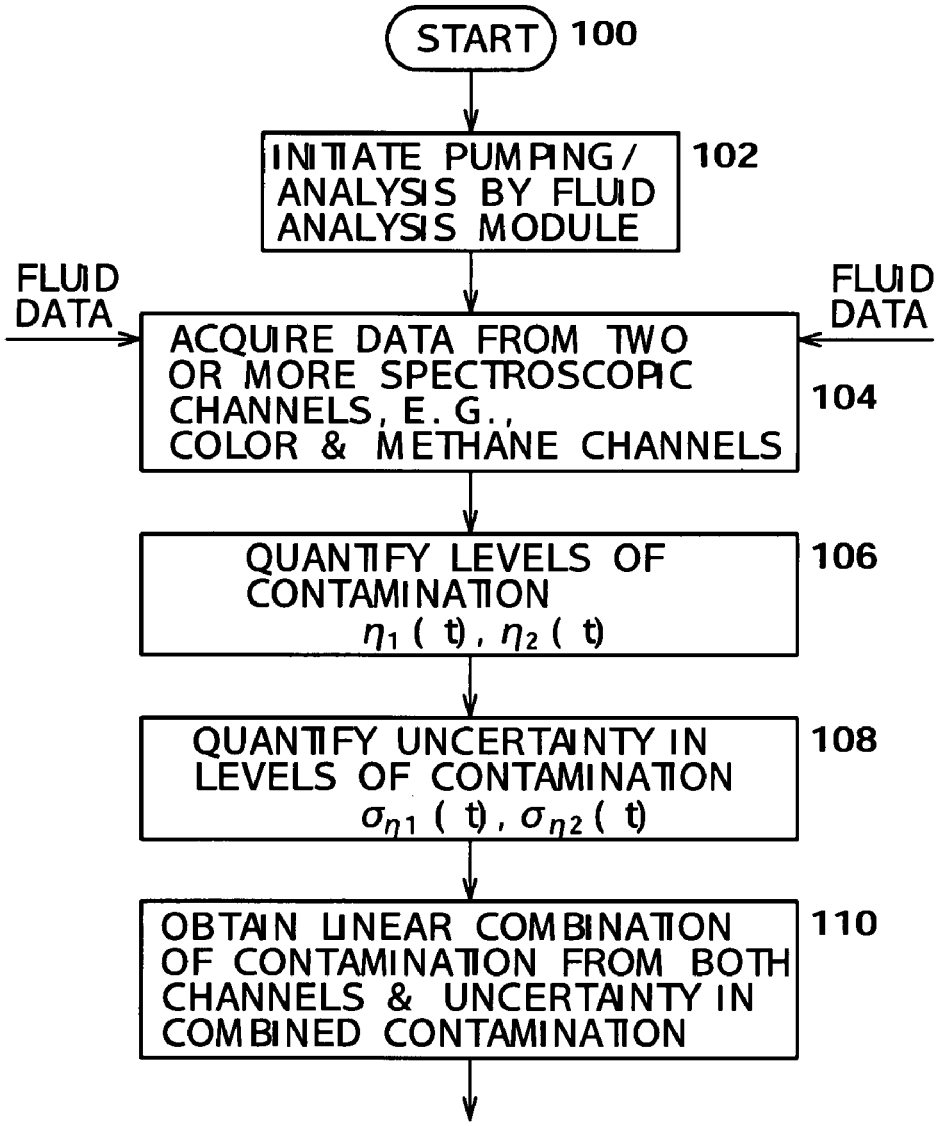
FIGS. 5(A) to 5(E) are flowcharts depicting preferred methods of comparing downhole fluids according to the present invention and deriving answer products thereof.

FIG. 5(A) represents in a flowchart a preferred method for quantifying contamination and uncertainty in contamination according to the present invention. When an operation of the fluid analysis module 32 is commenced (Step 100), the probe 28 is extended out to contact with the formation (note FIG. 2). Pumpout module 38 draws formation fluid into the flowline 33 and drains it to the mud while the fluid flowing in the flowline 33 is analyzed by the module 32 (Step 102).

An oil-base mud contamination monitoring (OCM) algorithm quantifies contamination by monitoring a fluid property that clearly distinguishes mud-filtrate from formation hydrocarbon. If the hydrocarbon is heavy, for example, dark oil, the mud-filtrate, which is assumed to be colorless, is discriminated from formation fluid using the color channel of a fluid analysis module. If the hydrocarbon is light, for example, gas or volatile oil, the mud-filtrate, which is assumed to have no methane, is discriminated from formation fluid using the methane channel of the fluid analysis module. Described in further detail below is how contamination uncertainty can be quantified from two or more channels, e.g., color and methane channels.

Quantification of contamination uncertainty serves three purposes. First, it enables propagation of uncertainty in contamination into other fluid properties, as described in further detail below. Second, a linear combination of contamination from two channels, for example, the color and methane channels, can be obtained such that a resulting contamination has a smaller uncertainty as compared with contamination uncertainty from either of the two channels. Third, since the OCM is applied to all clean-ups of mud filtrate regardless of the pattern of fluid flow or kind of formation, quantifying contamination uncertainty provides a means of capturing model-based error due to OCM.

In a preferred embodiment of the invention, data from two or more channels, such as the color and methane channels, are acquired (Step 104). In the OCM, spectroscopic data such as, in a preferred embodiment, measured optical density d(t) with respect to time t is fit with a power-law model, $$d(t)=k_1-k_2t^{-5/12}. \tag{1.1}$$

The parameters $k_1$ and $k_2$ are computed by minimizing the difference between the data and the fit from the model. Let $$d=[d(1)\,d(2)\ \ldots\ d(t)\ \ldots\ d(N)]^T,\ k=[k_1\ k_2]^T \tag{1.2}$$

and $$A=\begin{bmatrix} | & | \\ 1 & -t^{-\frac{5}{12}} \\ | & | \end{bmatrix}=USV^T \tag{1.3}$$

where the matrices U, S and V are obtained from the singular value decomposition of matrix A and T denotes the transpose of a vector/matrix. The OCM model parameters and their uncertainty denoted by cov(k) are, $$k=VS^{-1}U^Td,\ \mathrm{cov}(k)=\sigma^2VS^{-2}V^T \tag{1.4}$$

where $\sigma^2$ is the noise variance in the measurement. Typically, it is assumed that the mud filtrate has negligible contribution to the optical density in the color channels and methane channel. In this case, the volumetric contamination $\eta(t)$ is obtained (Step 106) as $$\eta(t)=\frac{k_2}{k_1}t^{-\frac{5}{12}}. \tag{1.5}$$

The two factors that contribute to uncertainty in the predicted contamination are uncertainty in the spectroscopic measurement, which can be quantified by laboratory or field tests, and model-based error in the oil-base mud contamination monitoring (OCM) model used to compute the contamination. The uncertainty in contamination denoted by $\sigma_\eta(t)$ (derived in Step 108) due to uncertainty in the measured data is, $$\sigma_\eta^2(t)=t^{-10/12}\left[\frac{-k_2}{k_1^2}\ \frac{1}{k_1}\right]\mathrm{cov}(k)\left[\frac{-k_2}{k_1^2}\ \frac{1}{k_1}\right]^T. \tag{1.6}$$

Analysis of a number of field data sets supports the validity of a simple power-law model for contamination as specified in Equation 1.1. However, often the model-based error may be more dominant than the error due to uncertainty in the noise. One measure of the model-based error can be obtained from the difference between the data and the fit as, $$\sigma^2=\frac{\|d-Ak\|^2}{N}. \tag{1.7}$$

This estimate of the variance from Equation 1.7 can be used to replace the noise variance in Equation 1.4. When the model provides a good fit to the data, the variance from Equation 1.7 is expected to match the noise variance. On the other hand, when the model provides a poor fit to the data, the model-based error is much larger reflecting a larger value of variance in Equation 1.7. This results in a larger uncertainty in parameter k in Equation 1.4 and consequently a larger uncertainty in contamination $\eta(t)$ in Equation 1.6.

A linear combination of the contamination from both color and methane channels can be obtained (Step 110) such that the resulting contamination has a smaller uncertainty compared to contamination from either of the two channels. Let the contamination and uncertainty from the color and methane channels at any time be denoted as $\eta_1(t)$,$\sigma_{\eta 1}(t)$ and $\eta_2(t)$, $\sigma_{\eta 2}(t)$, respectively. Then, a more "robust" estimate of contamination can be obtained as, $$\eta(t)=\beta_1(t)\eta_1(t)+\beta_2(t)\eta_2(t) \tag{1.8}$$

where $$\beta_1(t)=\frac{\sigma_{\eta_2}^2(t)}{\sigma_{\eta_1}^2(t)+\sigma_{\eta_2}^2(t)},\ \text{and}\ \beta_2=\frac{\sigma_{\eta_1}^2(t)}{\sigma_{\eta_1}^2(t)+\sigma_{\eta_2}^2(t)}.$$

The estimate of contamination is more robust since it is an unbiased estimate and has a smaller uncertainty than either of the two estimates $\eta_1(t)$ and $\eta_2(t)$. The uncertainty in contamination $\eta(t)$ in Equation 1.8 is, $$\sigma_\eta(t)=\sqrt{\beta_1(t)\sigma_{\eta_1}^2+\beta_2(t)\sigma_{\eta_2}^2}=\frac{\sigma_{\eta_1}(t)\sigma_{\eta_2}(t)}{\sqrt{\sigma_{\eta_1}^2(t)+\sigma_{\eta_2}^2(t)}}. \tag{1.9}$$

A person skilled in the art will understand that Equations 1.3 to 1.9 can be modified to incorporate the effect of a weighting matrix used to weigh the data differently at different times.

Comparison of Two Fluids with Levels of Contamination

Figure 5B:
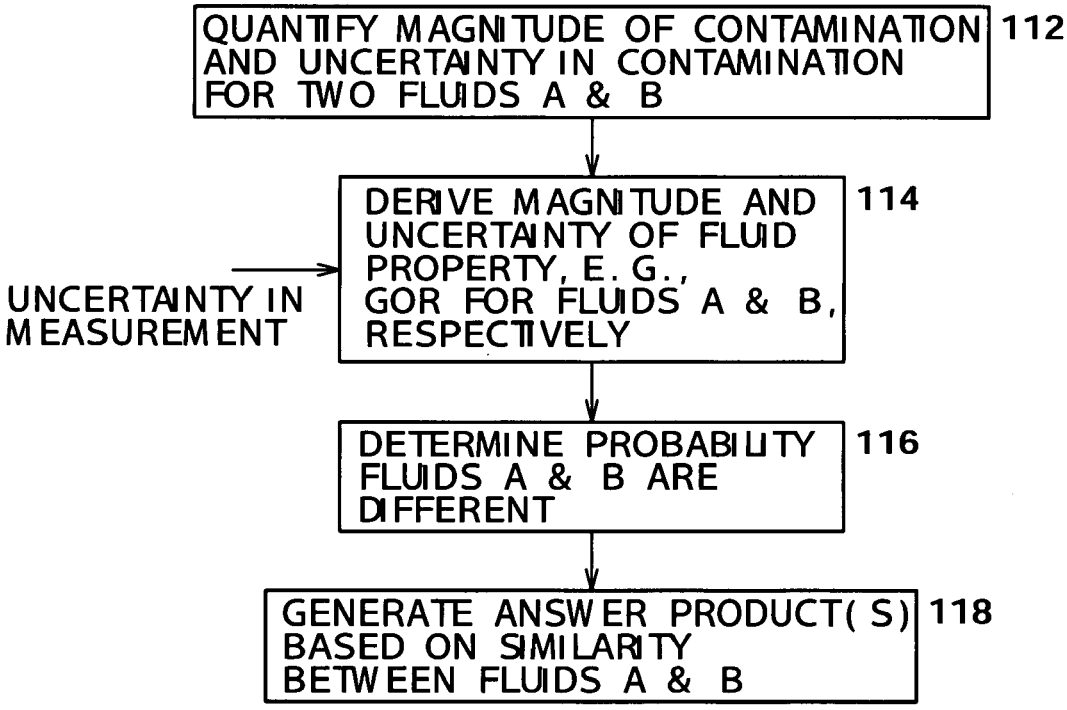

FIG. 5(B) represents in a flowchart a preferred method for comparing an exemplary fluid property of two fluids according to the present invention. In preferred embodiments of the invention, four fluid properties are used to compare two fluids, viz., live fluid color, dead-crude spectrum, GOR and fluorescence. For purposes of brevity, one method of comparison of fluid properties is described with respect to GOR of a fluid. The method described, however, is applicable to any other fluid property as well.

Let the two fluids be labeled A and B. The magnitude and uncertainty in contamination (derived in Step 112, as described in connection with FIG. 5(A), Steps 106 and 108, above) and uncertainty in the measurement for the fluids A and B (obtained by hardware calibration in the laboratory or by field tests) are propagated into the magnitude and uncertainty of GOR (Step 114). Let $\mu_A$,$\sigma^2_A$ and $\mu_B$,$\sigma^2_B$ denote the mean and uncertainty in GOR of fluids A and B, respectively.

In the absence of any information about the density function, it is assumed to be Gaussian specified by a mean and uncertainty (or variance). Thus, the underlying density functions $f_A$ and $f_B$ (or equivalently the cumulative distribution functions $F_A$ and $F_B$) can be computed from the mean and uncertainty in the GOR of the two fluids. Let x and y be random variables drawn from density functions $f_A$ and $f_B$, respectively. The probability $P_1$ that GOR of fluid B is statistically larger than GOR of fluid A is, $$P_1 = \int f_B(y > x \mid x)\, f_A(x)\, dx = \int [1 - F_B(x)]\, f_A(x)\, dx \tag{1.10}$$

When the probability density function is Gaussian, Equation 1.10 reduces to, $$P_1 = \frac{1}{\sqrt{8\pi}\,\sigma_A} \int_{-\infty}^{\infty} \mathrm{erfc}\left(\frac{x-\mu_B}{\sqrt{2}\,\sigma_B}\right) \exp\left(\frac{-(x-\mu_A)^2}{2\sigma_A^2}\right) dx \tag{1.11}$$

where erfc( ) refers to the complementary error function. The probability $P_1$ takes value between 0 and 1. If $P_1$ is very close to zero or 1, the two fluids are statistically quite different. On the other hand, if $P_1$ is close to 0.5, the two fluids are similar.

An alternate and more intuitive measure of difference between two fluids (Step 116) is, $$P_2 = 2|P_1 - 0.5| \tag{1.12}$$

The parameter $P_2$ reflects the probability that the two fluids are statistically different. When $P_2$ is close to zero, the two fluids are statistically similar. When $P_2$ is close to 1, the fluids are statistically very different. The probabilities can be compared to a threshold to enable qualitative decisions on the similarity between the two fluids (Step 118).

Figure 5C:
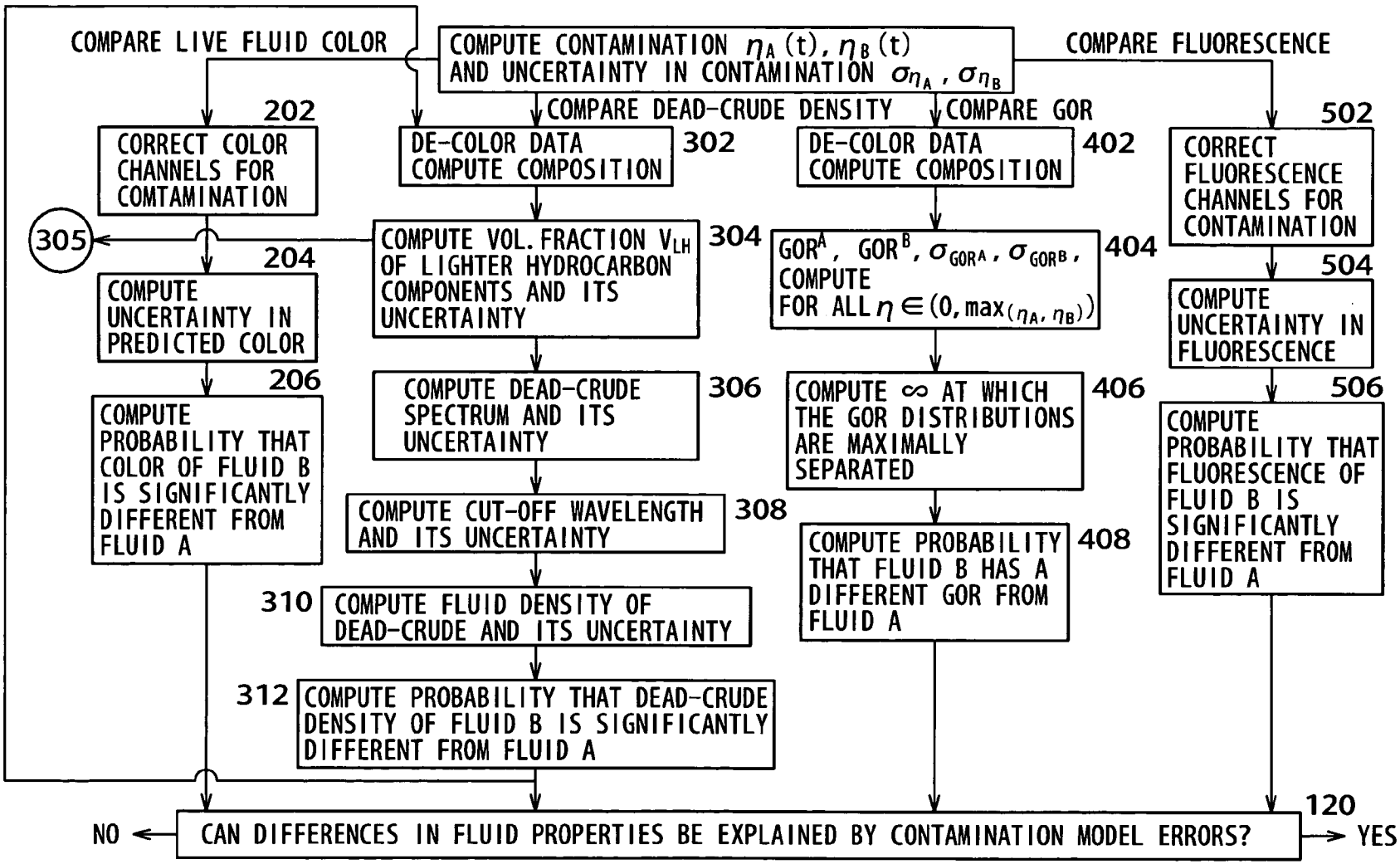

Hereinafter, four exemplary fluid properties and their corresponding uncertainties are derived, as represented in the flowcharts of FIG. 5(C), by initially determining contamination and uncertainty in contamination for the fluids of interest (Step 112 above). The difference in the fluid properties of the two or more fluids is then quantified using Equation 1.12 above.

Magnitude and Uncertainty in Live Fluid Color

Assuming that mud filtrate has no color, the live fluid color at any wavelength λ at any time instant t can be obtained from the measured optical density (OD) $S_\lambda(t)$, $$S_{\lambda,LF}(t) = \frac{S_\lambda(t)}{1 - \eta(t)} \tag{1.13}$$

Uncertainty in the live fluid color tail is, $$\sigma^2_{S_{\lambda,LF}}(t) = \frac{\sigma^2}{[1-\eta(t)]^2} + \frac{\sigma_\eta^2(t)\, S_\lambda^2(t)}{[1-\eta(t)]^4} \tag{1.14}$$

The two terms in Equation 1.14 reflect the contributions due to uncertainty in the measurement $S_\lambda(t)$ and contamination η(t), respectively. Once the live fluid color (Step 202) and associated uncertainty (Step 204) are computed for each of the fluids that are being compared, the two fluid colors can be compared in a number of ways (Step 206). For example, the colors of the two fluids can be compared at a chosen wavelength. Equation 1.14 indicates that the uncertainty in color is different at different wavelengths. Thus, the most sensitive wavelength for fluid comparison may be chosen to maximize discrimination between the two fluids. Another method of comparison is to capture the color at all wavelengths and associated uncertainties in a parametric form. An example of such a parametric form is, $$S_{\lambda,LF} = \alpha \exp(\beta/\lambda).$$

In this example, the parameters α, β and their uncertainties may be compared between the two fluids using Equations 1.10 to 1.12 above to derive the probability that colors of the fluids are different (Step 206).

Dead-Crude Spectrum and its Uncertainty

A second fluid property that may be used to compare two fluids is dead-crude spectrum or answer products derived in part from the dead-crude spectrum. Dead-crude spectrum essentially equals the live oil spectrum without the spectral absorption of contamination, methane, and other lighter hydrocarbons. It can be computed as follows. First, the optical density data can be decolored and the composition of the fluids computed using LFA and/or CFA response matrices (Step 302) by techniques that are known to persons skilled in the art. Next, an equation of state (EOS) can be used to compute the density of methane and light hydrocarbons at measured reservoir temperature and pressure. This enables computation of the volume fraction of the lighter hydrocarbons $V_{LH}$ (Step 304). For example, in the CFA, the volume fraction of the light hydrocarbons is, $$V_{LH} = \gamma_1 m_1 + \gamma_2 m_2 + \gamma_4 m_4 \tag{1.15}$$

where $m_1$, $m_2$, and $m_4$ are the partial densities of $C_1$, $C_2$-$C_5$ and $CO_2$ computed using principal component analysis or partial-least squares or an equivalent algorithm. The parameters $\gamma_1$, $\gamma_2$ and $\gamma_4$ are the reciprocal of the densities of the three groups at specified reservoir pressure and temperature. The uncertainty in the volume fraction (Step 304) due to uncertainty in the composition is, $$\sigma_V^2 = [\,\gamma_1 \quad \gamma_2 \quad \gamma_4\,]\,\Lambda \begin{bmatrix} \gamma_1 \\ \gamma_2 \\ \gamma_4 \end{bmatrix} \tag{1.16}$$

where Λ is the covariance matrix of components $C_1$, $C_2$-$C_5$ and $CO_2$ computed using the response matrices of LFA and/or CFA, respectively. From the measured spectrum $S_\lambda(t)$, the dead-crude spectrum $S_{\lambda,dc}(t)$ can be predicted (Step 306) as, $$S_{\lambda,dc}(t) = \frac{S_\lambda(t)}{1 - V_{LH}(t) - \eta(t)} \tag{1.17}$$

The uncertainty in the dead-crude spectrum (Step 306) is, $$\sigma^2_{S_{\lambda,dc}}(t) = \frac{\sigma^2(t)}{[1 - V_{LH}(t) - \eta(t)]^2} + \frac{\sigma^2_V(t)S^2_\lambda(t)}{[1 - V_{LH}(t) - \eta(t)]^4} + \frac{\sigma^2_\eta(t)S^2_\lambda(t)}{[1 - V_{LH}(t) - \eta(t)]^4} \quad (1.18)$$

The three terms in Equation 1.18 reflect the contributions in uncertainty in the dead-crude spectrum due to uncertainty in the measurement $S_\lambda(t)$, the volume fraction of light hydrocarbon $V_{LH}(t)$ and contamination $\eta(t)$, respectively. The two fluids can be directly compared in terms of the dead-crude spectrum at any wavelength. An alternative and preferred approach is to capture the uncertainty in all wavelengths into a parametric form. An example of a parametric form is, $$S_{\lambda,dc}=\alpha \exp(\beta/\lambda) \quad (1.19)$$

The dead-crude spectrum and its uncertainty at all wavelengths can be translated into parameters $\alpha$ and $\beta$ and their uncertainties. In turn, these parameters can be used to compute a cut-off wavelength and its uncertainty (Step 308).

Figure 6A:
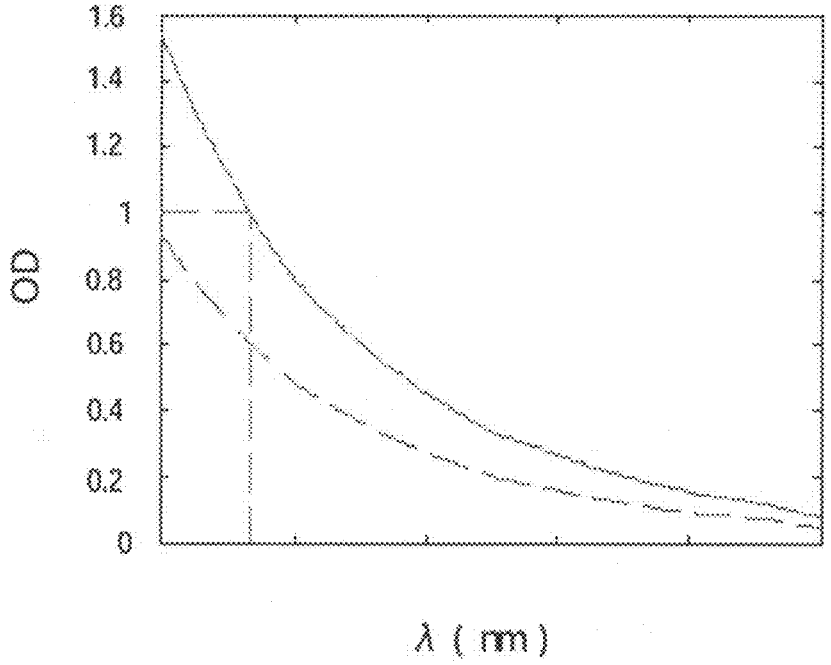
FIG. 6(A) shows graphically an example of measured (dashed line) and predicted (solid line) dead-crude spectra of a hydrocarbon and FIG. 6(B) represents an empirical correlation between cut-off wavelength and dead-crude spectrum.

FIG. 6(*a*) shows an example of the measured spectrum (dashed line) and the predicted dead-crude spectrum (solid line) of a hydrocarbon. The dead-crude spectrum can be parameterized by cut-off wavelength defined as the wavelength at which the OD is equal to 1. In this example, the cut-off wavelength is around 570 nm.

Figure 6B:
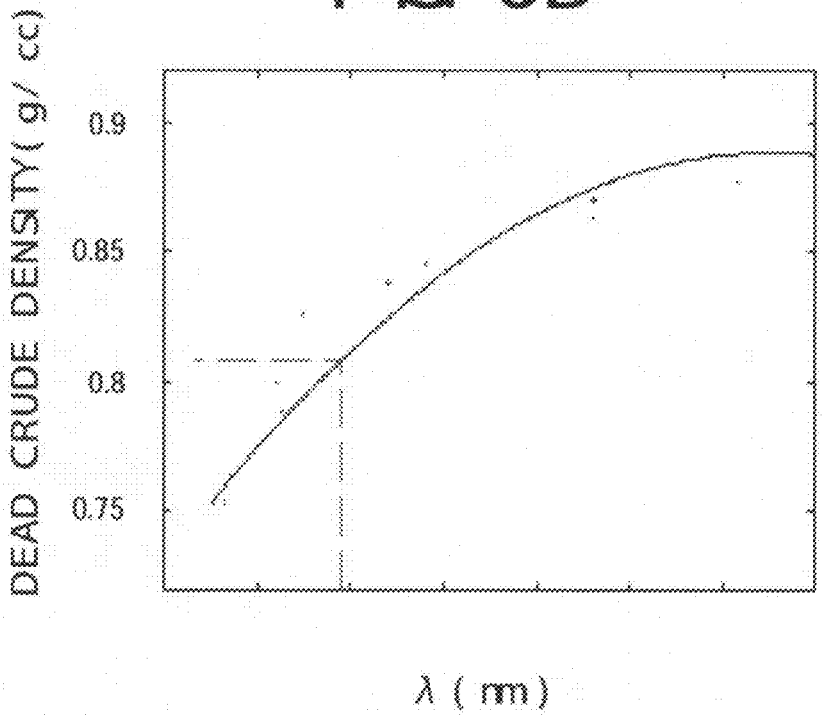

Often, correlations between cut-off wavelength and dead-crude density are known. An example of a global correlation between cut-off wavelength and dead-crude density is shown in FIG. 6(B). FIG. 6(B) helps translate the magnitude and uncertainty in cut-off wavelength to a magnitude and uncertainty in dead-crude density (Step 310). The probability that the two fluids are statistically different with respect to the dead-crude spectrum, or its derived parameters, can be computed using Equations 1.10 to 1.12 above (Step 312).

The computation of the dead-crude spectrum and its uncertainty has a number of applications. First, as described herein, it allows easy comparison between two fluids. Second, the CFA uses lighter hydrocarbons as its training set for principal components regressions; it tacitly assumes that the $C_{6+}$ components have density of ~0.68 g/cm$^3$, which is fairly accurate for dry gas, wet gas, and retrograde gas, but is not accurate for volatile oil and black oil. Thus, the predicted dead-crude density can be used to modify the $C_{6+}$ component of the CFA algorithm to better compute the partial density of the heavy components and thus to better predict the GOR. Third, the formation volume factor ($B_O$), which is a valuable answer product for users, is a by-product of the analysis (Step 305), $$B_0 \sim \frac{1}{1 - V_{LH}}. \quad (1.20)$$

The assumed correlation between dead-crude density and cut-off wavelength can further be used to constrain and iteratively compute $B_0$. This method of computing the formation volume factor is direct and circumvents alternative indirect methods of computing the formation volume factor using correlation methods. Significantly, the density of the light hydrocarbons computed using EOS is not sensitive to small perturbations of reservoir pressure and temperature. Thus, the uncertainty in density due to the use of EOS is negligibly small.

Gas-Oil Ration (GOR) and its Uncertainty

GOR computations in LFA and CFA are known to persons skilled in the art. For purposes of brevity, the description herein will use GOR computation for the CFA. The GOR of the fluid in the flowline is computed (Step 404) from the composition, $$GOR = k\frac{x}{y - \beta x} scf / stb$$

where scalars k=107285 and $\beta$=0.782. Variables x and y denote the weight fraction in the gas and liquid phases, respectively. Let $[m_1\ m_2\ m_3\ m_4]$ denote the partial densities of the four components $C_1$, $C_2$-$C_5$, $C_{6+}$ and $CO_2$ after decoloring the data, i.e., removing the color absorption contribution from NIR channels (Step 402). Assuming that $C_1$, $C_2$-$C_5$ and $CO_2$ are completely in the gas phase and $C_{6+}$ is completely in the liquid phase, $$x=\alpha_1 m_1+\alpha_2 m_2+\alpha_4 m_4$$

and $$y=m_3$$

where $$\alpha_1=1/16,\ \alpha_2=1/40.1 \text{ and } \alpha_4=1/44.$$

Equation 1.21 assumes $C_{6+}$ is in the liquid phase, but its vapor forms part of the gaseous phase that has dynamic equilibrium with the liquid. The constants $\alpha_1$, $\alpha_2$, $\alpha_4$ and $\beta$ are obtained from the average molecular weight of $C_1$, $C_2$-$C_5$, $C_{6+}$ and $CO_2$ with an assumption of a distribution in $C_2$-$C_5$ group.

If the flowline fluid contamination $\eta^*$ is small, the GOR of the formation fluid can be obtained by subtracting the contamination from the partial density of $C_{6+}$. In this case, the GOR of formation fluid is given by Equation 1.21 where $y=m_3-\eta^*\rho$ where $\rho$ is the known density of the OBM filtrate. In fact, the GOR of the fluid in the flowline at any other level of contamination $\eta$ can be computed using Equation 1.21 with $y=m_3-(\eta^*-\eta)\rho$. The uncertainty in the GOR (derived in Step 404) is given by, $$\sigma^2_{GOR} = k^2\left[\frac{y}{(y-\beta x)^2}\ \frac{-x}{(y-\beta x)^2}\right]\begin{bmatrix}\sigma^2_x & \sigma_{xy}\\ \sigma_{xy} & \sigma^2_y\end{bmatrix}\begin{bmatrix}\frac{y}{(y-\beta x)^2}\\ \frac{-x}{(y-\beta x)^2}\end{bmatrix} \quad (1.22)$$

where $$\sigma^2_x = [\ \alpha_1\quad \alpha_2\quad \alpha_4\ ]\Lambda\begin{bmatrix}\alpha_1\\ \alpha_2\\ \alpha_4\end{bmatrix}. \quad (1.23)$$

$\Lambda$ is the covariance matrix of components $m_1$, $m_2$ and $m_4$ and computed from CFA analysis and $$\sigma_y^2=\sigma_{m_3}^2+\rho^2\sigma_\eta^2 \quad (1.24)$$

$$\sigma_{xy}=\alpha_1\sigma_{m_1m_3}+\alpha_2\sigma_{m_2m_3}+\alpha_4\sigma_{m_3m_4}. \quad (1.25)$$

In Equations 1.24 and 1.25, the variable $\sigma_{xy}$ refers to the correlation between random variables x and y.

Figure 7:
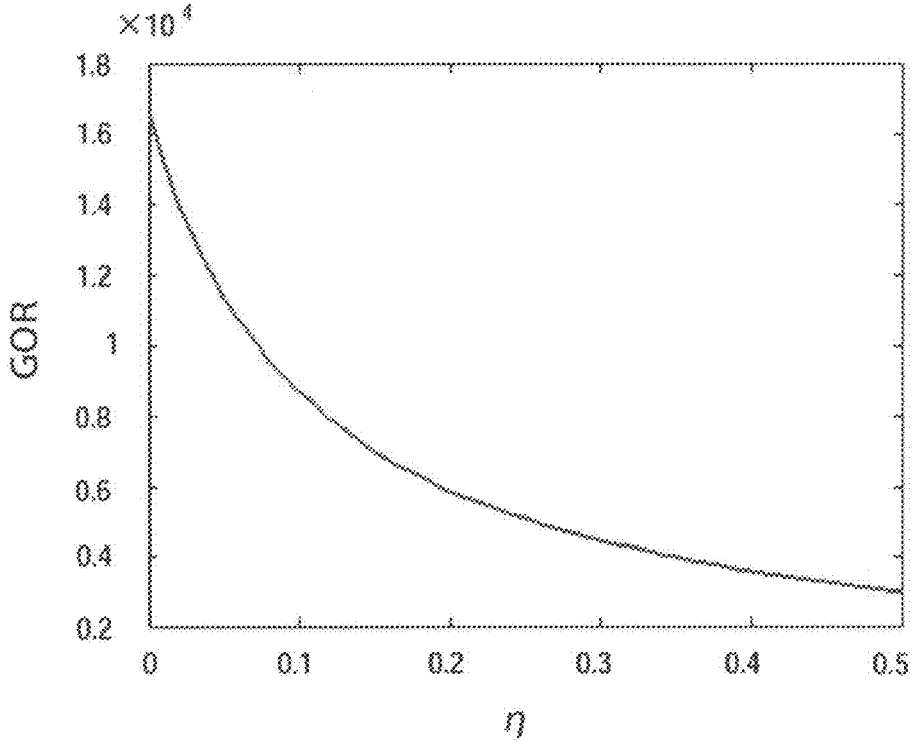
FIG. 7 illustrates, in a graph, variation of GOR (in scf/stb) of a retrograde-gas as a function of volumetric contamination. At small contamination levels, GOR is very sensitive to volumetric contamination; small uncertainty in contamination can result in large uncertainty in GOR.

FIG. 7 illustrates an example of variation of GOR (in scf/stb) of a retrograde-gas with respect to volumetric contamination. At small contamination levels, the measured flowline GOR is very sensitive to small changes in volumetric contamination. Therefore, small uncertainty in contamination can result in large uncertainty in GOR.

Figure 8A:
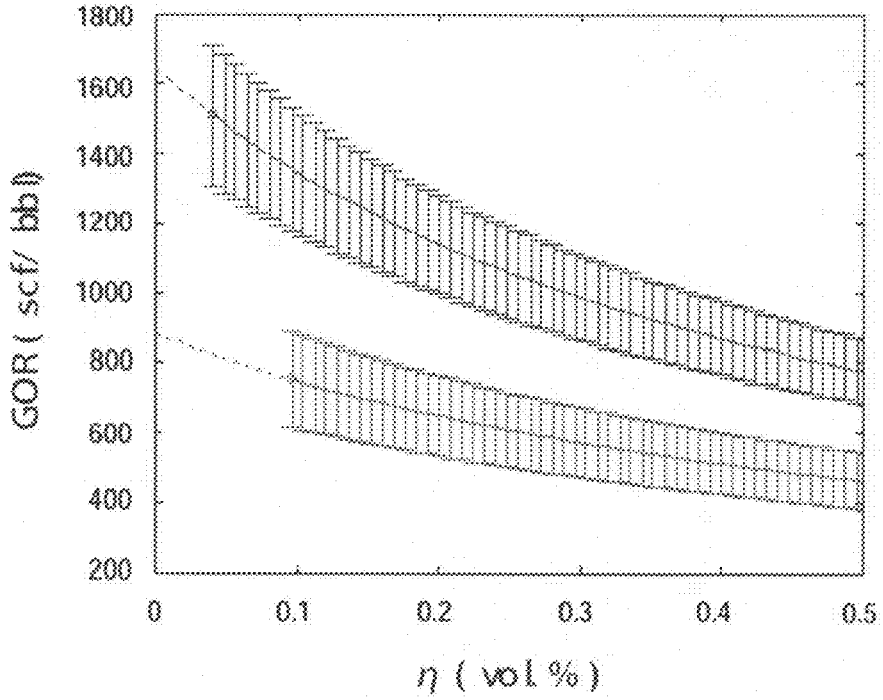
FIG. 8(A) graphically shows GOR and corresponding uncertainties for fluids A (blue) and B (red) as functions of volumetric contamination. The final contamination of fluid A is $\eta_A$=5% whereas the final contamination for fluid B is $\eta_B$=10%.

FIG. 8(A) shows an example to illustrate an issue resolved by applicants in the present invention, viz., what is a robust method to compare GORs of two fluids with different levels of contamination? FIG. 8(A) shows GOR plotted as a function of contamination for two fluids. After hours of pumping, fluid A (blue trace) has a contamination of $\eta_A$=5% with an uncertainty of 2% whereas fluid B (red trace) has a contamination of $\eta_B$=10% with an uncertainty of 1%. Known methods of analysis tacitly compare the two fluids by predicting the GOR of the formation fluid, projected at zero-contamination, using Equation 1.21 above. However, at small contamination levels, the uncertainty in GOR is very sensitive to uncertainty in contamination resulting in larger error-bars for predicted GOR of the formation fluid.

A more robust method is to compare the two fluids at a contamination level optimized to discriminate between the two fluids. The optimal contamination level is found as follows. Let $\mu_A(\eta)$,$\sigma^2_A(\eta)$ and $\mu_B(\eta)$,$\sigma^2_B(\eta)$ denote the mean and uncertainty in GOR of fluids A and B, respectively, at a contamination $\eta$. In the absence of any information about the density function, it is assumed to be Gaussian specified by a mean and variance. Thus, at a specified contamination level, the underlying density functions $f_A$ and $f_B$, or equivalently the cumulative distribution functions $F_A$ and $F_B$, can be computed from the mean and uncertainty in GOR of the two fluids. The Kolmogorov-Smirnov (K-S) distance provides a natural way of quantifying the distance between two distributions $F_A$ and $F_B$, $$d=\max[F_A-F_B] \tag{1.26}$$

Figure 8B:
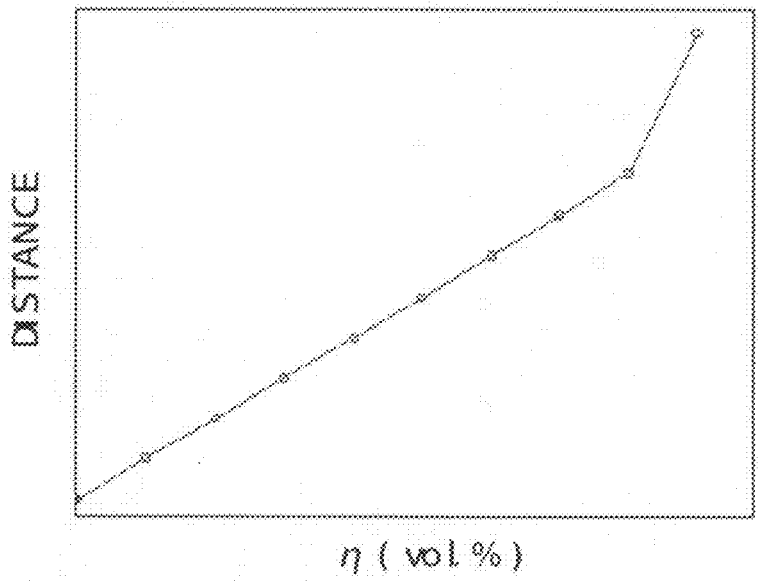
FIG. 8(B) is a graphical illustration of the K-S distance as a function of contamination. The GOR of the two fluids is best compared at $\eta_B$, where sensitivity to distinguishing between the two fluids is maximum, which can reduce to comparison of the optical densities of the two fluids when contamination level is $\eta_B$.

An optimal contamination level for fluid comparison can be chosen to maximize the K-S distance. This contamination level denoted by $\eta^{\sim}$ (Step 406) is "optimal" in the sense that it is most sensitive to the difference in GOR of the two fluids. FIG. 8(B) illustrates the distance between the two fluids. In this example, the distance is maximum at $\eta^{\sim}=\eta_B$=10%. The comparison of GOR in this case can collapse to a direct comparison of optical densities of the two fluids at contamination level of $\eta_B$. Once the optimal contamination level is determined, the probability that the two fluids are statistically different with respect to GOR can be computed using Equations 1.10 to 1.12 above (Step 408). The K-S distance is preferred for its simplicity and is unaffected by reparameterization. For example, the K-S distance is independent of using GOR or a function of GOR such as log(GOR). Persons skilled in the art will appreciate that alternative methods of defining the distance in terms of Anderson-Darjeeling distance or Kuiper's distance may be used as well.

Fluorescence and its Uncertainty

Fluorescence spectroscopy is performed by measuring light emission in the green and red ranges of the spectrum after excitation with blue light. The measured fluorescence is related to the amount of polycyclic aromatic hydrocarbons (PAH) in the crude oil.

Quantitative interpretation of fluorescence measurements can be challenging. The measured signal is not necessarily linearly proportional to the concentration of PAH (there is no equivalent Beer-Lambert law). Furthermore, when the concentration of PAH is quite large, the quantum yield can be reduced by quenching. Thus, the signal often is a non-linear function of GOR. Although in an ideal situation only the formation fluid is expected to have signal measured by fluorescence, surfactants in OBM filtrate may be a contributing factor to the measured signal. In WBM, the measured data may depend on the oil and water flow regimes.

In certain geographical areas where water-base mud is used, CFA fluorescence has been shown to be a good indicator of GOR of the fluid, apparent hydrocarbon density from the CFA and mass fractions of $C_1$ and $C_{6+}$. These findings also apply to situations with OBM where there is low OBM contamination (<2%) in the sample being analyzed. Furthermore, the amplitude of the fluorescence signal is seen to have a strong correlation with the dead-crude density. In these cases, it is desirable to compare two fluids with respect to the fluorescence measurement. As an illustration, a comparison with respect to the measurement in CFA is described herein. Let $F_0^A$, $F_1^A$, $F_0^B$ and $F_1^B$ denote the integrated spectra above 550 and 680 nm for fluids A and B, respectively, with OBM contamination $\eta_A$,$\eta_B$, respectively. When the contamination levels are small, the integrated spectra can be compared after correction for contamination (Step 502). Thus, $$\frac{F_0^A}{1-\eta_A} \approx \frac{F_0^B}{1-\eta_B} \text{ and } \frac{F_1^A}{1-\eta_A} \approx \frac{F_1^B}{1-\eta_B}$$

within an uncertainty range quantified by uncertainty in contamination and uncertainty in the fluorescence measurement (derived in Step 504 by hardware calibration in the laboratory or by field tests). If the measurements are widely different, this should be flagged to the operator as a possible indication of difference between the two fluids. Since several other factors such as a tainted window or orientation of the tool or flow regime can also influence the measurement, the operator may choose to further test that the two fluorescence measurements are genuinely reflective of the difference between the two fluids.

As a final step in the algorithm, the probability that the two fluids are different in terms of color (Step 206), GOR (Step 408), fluorescence (Step 506), and dead-crude spectrum (Step 312) or its derived parameters is given by Equation 1.12 above. Comparison of these probabilities with a user-defined threshold, for example, as an answer product of interest, enables the operator to formulate and make decisions on composition gradients and compartmentalization in the reservoir.

FIELD EXAMPLE

CFA was run in a field at three different stations labeled A, B and D in the same well bore. GORs of the flowline fluids obtained from the CFA are shown in Table I in column 2. In this job, the fluid was flashed at the surface to recompute the GOR shown in column 3. Further, the contamination was quantified using gas-chromatography (column 4) and the corrected well site GOR are shown in the last column 5. Column 2 indicates that there may be a composition gradient in the reservoir. This hypothesis is not substantiated by column 3.

TABLE I

| | GOR from CFA (scf/stb) | Wellsite GOR (as is) | OBM % | Corrected well-site GOR |
|---|---|---|---|---|
| A | 4010 | 2990 | 1 | 3023 |
| B | 3750 | 2931 | 3.8 | 3058 |
| D | 3450 | 2841 | 6.6 | 3033 |

Figure 9:
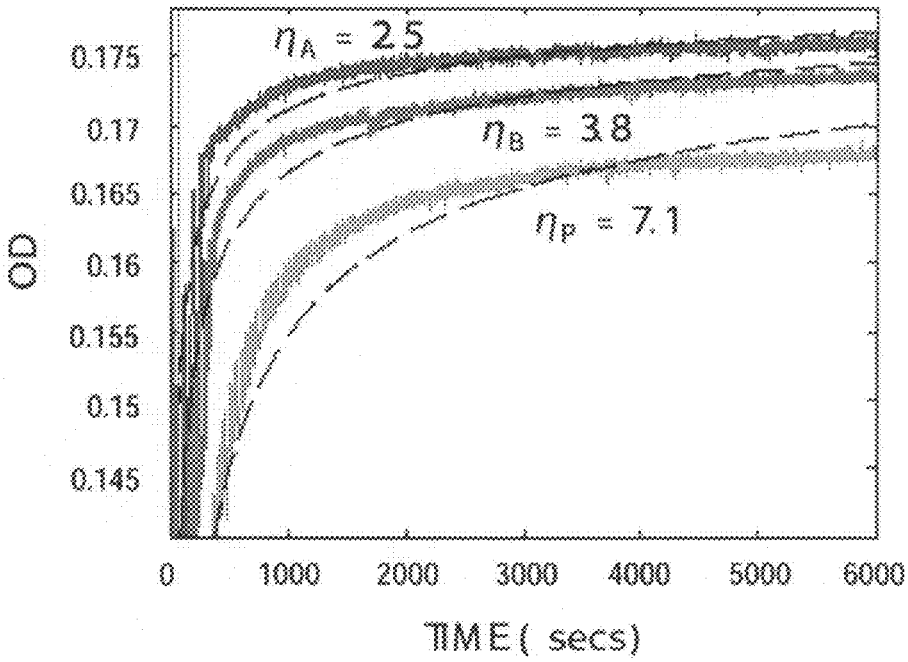
FIG. 9 graphically shows optical density (OD) from the methane channel (at 1650 nm) for three stations A (blue), B (red) and D (magenta). The fit from the contamination model is shown in dashed black trace for all three curves. The contamination just before samples were collected for stations A, B and D are 2.6%, 3.8% and 7.1%, respectively.

The data were analyzed by the methods of the present invention. FIG. 9 shows the methane channel of the three stations A, B and D (blue, red and magenta). The black trace is the curve fitting obtained by OCM. The final volumetric contamination levels before the samples were collected were estimated as 2.6, 3.8 and 7.1%, respectively. These contamination levels compare reasonably well with the contamination levels estimated at the well site in Table I.

Figure 10:
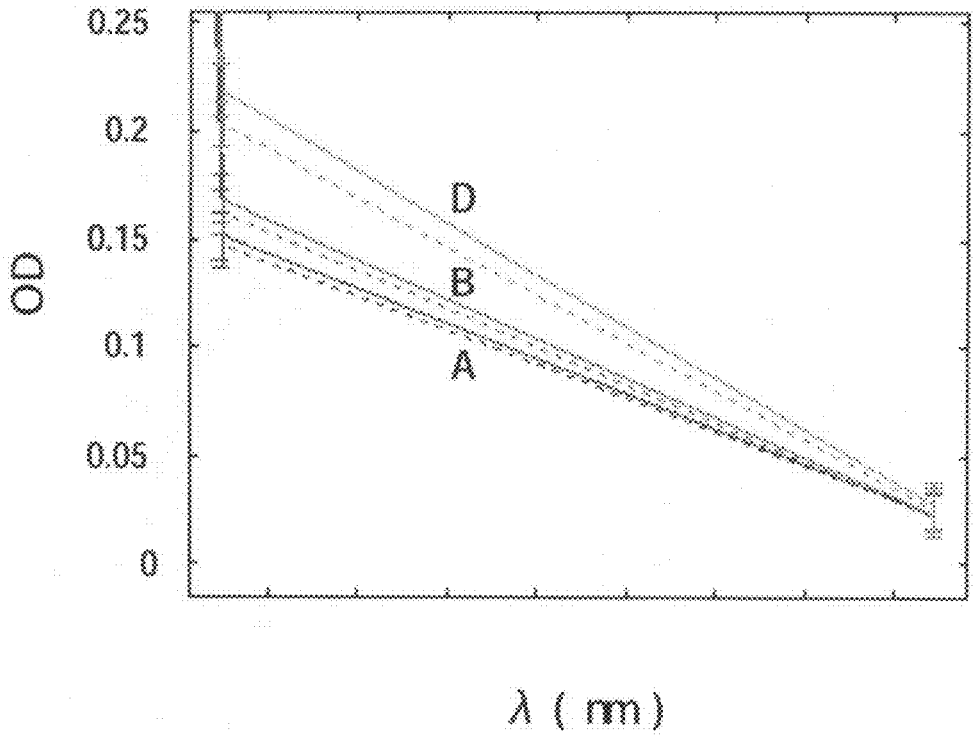
FIG. 10 graphically illustrates a comparison of measured ODs (dashed traces) and live fluid spectra (solid traces) for stations A (blue), B (red) and D (magenta). The fluid at station D is darker and is statistically different from stations A and B. Fluids at stations A and B are statistically different with a probability of 0.72. The fluids were referred to in FIG. 9 above.

FIG. 10 shows the measured data (dashed lines) with the predicted live fluid spectra (solid lines) of the three fluids. It is very evident that fluid at station D is much darker and different from fluids at stations A and B. The probability that station D fluid is different from A and B is quite high (0.86). Fluid at station B has more color than station A fluid. Assuming a noise standard deviation of 0.01, the probability that the two fluids at stations A and B are different is 0.72.

Figure 11:
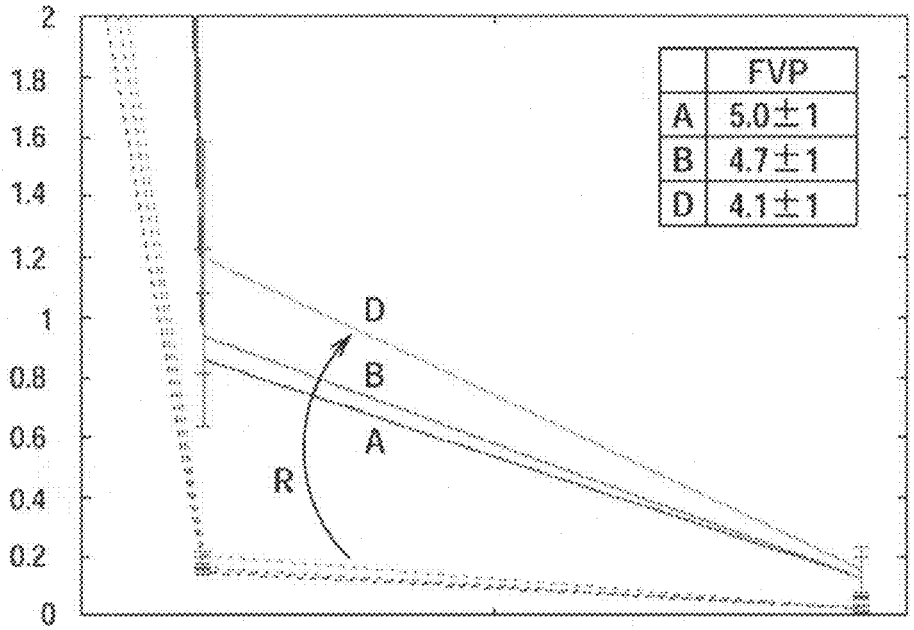
FIG. 11 graphically shows comparison of live fluid spectra (dashed traces) and predicted dead-crude spectra (solid traces) for the three fluids at stations A, B and D (also referred to above).
Figure 12:
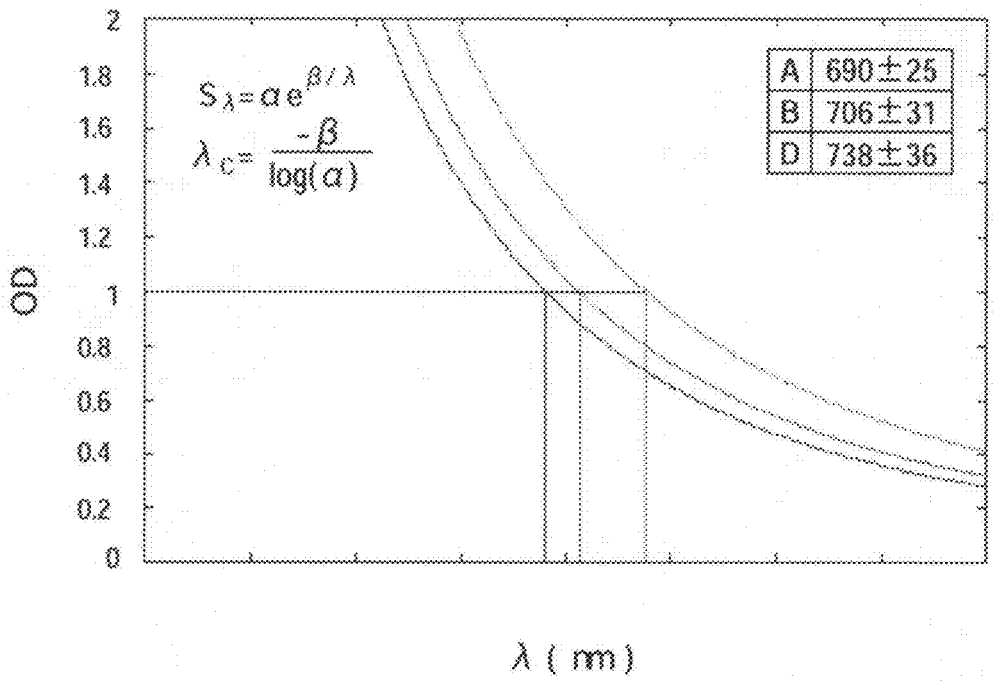
FIG. 12 graphically shows the cut-off wavelength obtained from the dead-crude spectrum and its uncertainty for the three fluids at stations A, B and D (also referred to above). The three fluids at stations A (blue), B (red) and D (magenta) are statistically similar in terms of the cut-off wavelength.
Figure 13:
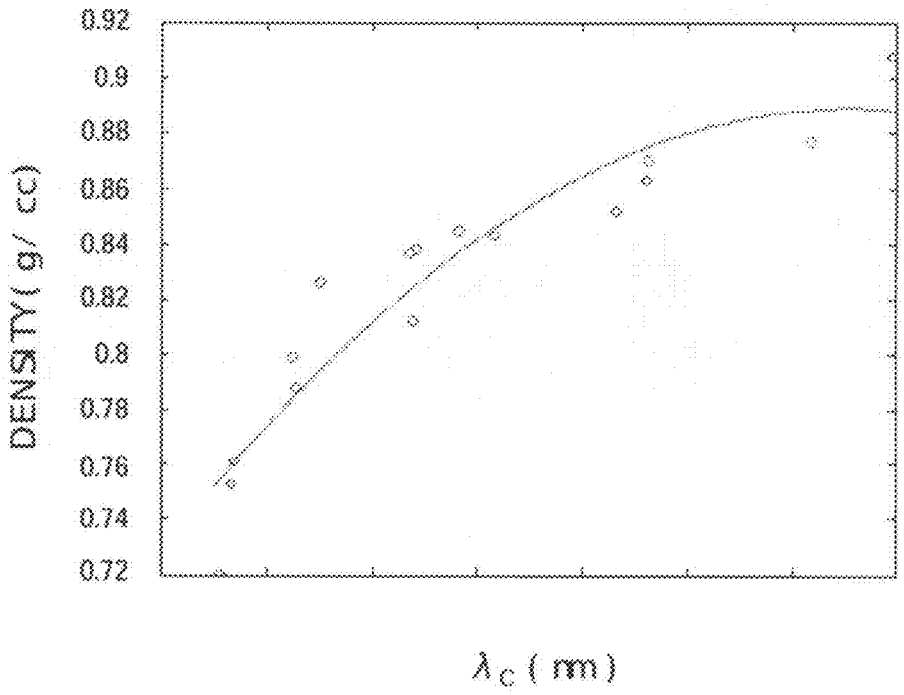
FIG. 13 is a graph showing the dead-crude density for all three fluids at stations A, B and D (also referred to above) is close to 0.83 g/cc.

FIG. 11 shows the live fluid spectra and the predicted dead-crude spectra with uncertainty. The inset shows the formation volume factor with its uncertainty for the three fluids. FIG. 12 shows the estimated cut-off wavelength and its uncertainty. FIGS. 11 and 12 illustrate that the three fluids are not statistically different in terms of cut-off wavelength. From FIG. 13, the dead-crude density for all three fluids is 0.83 g/cc.

Figure 14A:
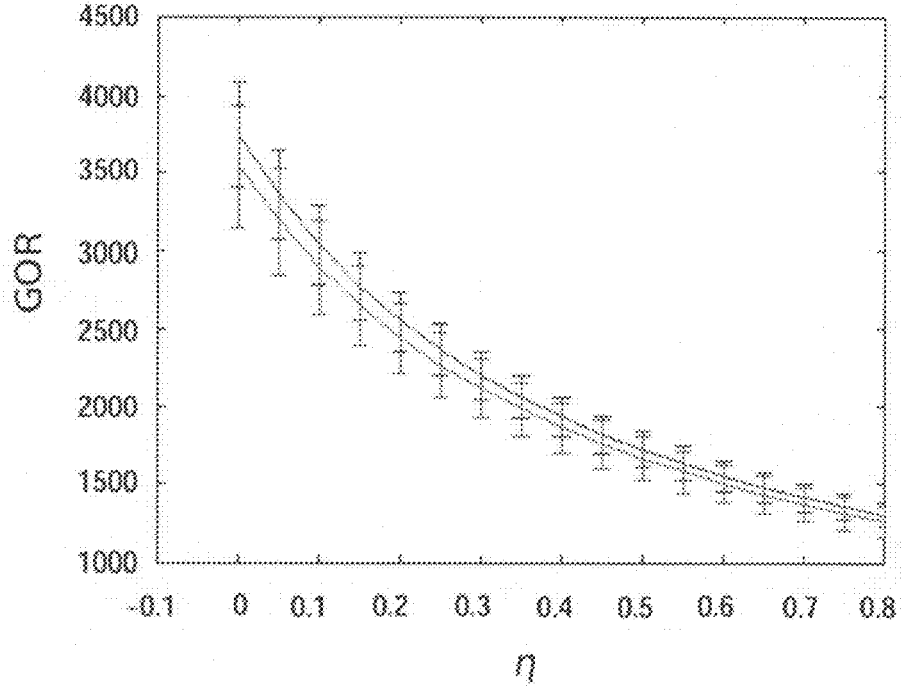
FIG. 14(A) graphically illustrates that GOR of fluids at stations A (blue) and B (red) are statistically similar and FIG. 14(B) illustrates that GOR of fluids at stations B (red) and D (magenta) also are statistically similar. The fluids were previously referred to above.
Figure 14B:
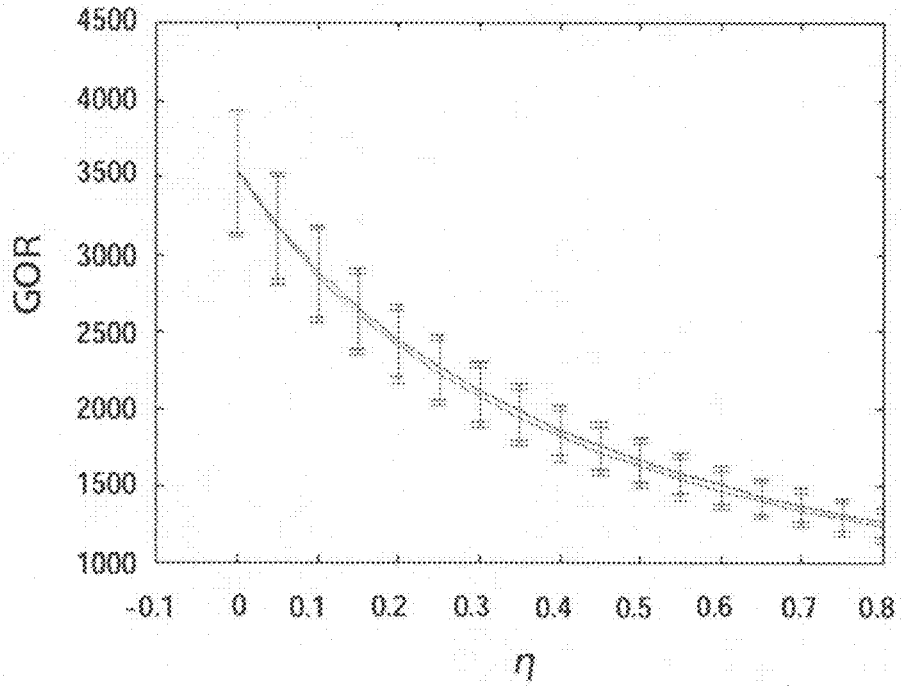

Statistical similarity or difference between fluids can be quantified in terms of the probability $P_2$ obtained from Equation 1.12. Table II quantifies the probabilities for the three fluids in terms of live fluid color, dead-crude density and GOR. The probability that fluids at stations A and B are statistically different in terms of dead-crude density is low (0.3). Similarly, the probability that fluids at stations B and D are statistically different is also small (0.5). FIGS. 14(A) and 14(B) show GOR of the three fluids with respect to contamination levels. As before, based on the GOR, the three fluids are not statistically different. The probability that station A fluid is statistically different from station B fluid is low (0.32). The probability that fluid at station B is different from D is close to zero.

TABLE II

| | Live fluid color | Dead crude density | GOR |
|---|---|---|---|
| $P_2$ (A ≠ B) | .72 | .3 | .32 |
| $P_2$ (B ≠ D) | 1 | .5 | .06 |

Comparison of these probabilities with a user-defined threshold enables an operator to formulate and make decisions on composition gradients and compartmentalization in the reservoir. For example, if a threshold of 0.8 is set, it would be concluded that fluid at station D is definitely different from fluids at stations A and B in terms of live-fluid color. For current processing, the standard deviation of noise has been set at 0.01 OD. Further discrimination between fluids at stations A and B can also be made if the standard deviation of noise in optical density is smaller.

As described above, aspects of the present invention provide advantageous answer products relating to differences in fluid properties derived from levels of contamination that are calculated with respect to downhole fluids of interest. In the present invention, applicants also provide methods for estimating whether the differences in fluid properties may be explained by errors in the OCM model (note Step 120 in FIG. 5(C)). In this, the present invention reduces the risk of reaching an incorrect decision by providing techniques to determine whether differences in optical density and estimated fluid properties can be explained by varying the levels of contamination (Step 120).

Table III compares the contamination, predicted GOR of formation fluid, and live fluid color at 647 nm for the three fluids. Comparing fluids at stations A and D, if the contamination of station A fluid is lower, the predicted GOR of the formation fluid at station A will be closer to D. However, the difference in color between stations A and D will be larger. Thus, decreasing contamination at station A drives the difference in GOR and difference in color between stations A and D in opposite directions. Hence, it is concluded that the difference in estimated fluid properties cannot be explained by varying the levels of contamination.

TABLE III

| | $\eta$ | GOR of formation fluid | Live fluid color at 647 nm |
|---|---|---|---|
| A | 2.6 | 3748 | .152 |
| B | 3.8 | 3541 | .169 |
| D | 7.1 | 3523 | .219 |

Advantageously, the probabilities that the fluid properties are different may also be computed in real-time so as to enable an operator to compare two or more fluids in real-time and to modify an ongoing sampling job based on decisions that are enabled by the present invention

Analysis in Water-Base Mud

The methods and systems of the present invention are applicable to analyze data where contamination is from water-base mud filtrate. Conventional processing of the water signal assumes that the flow regime is stratified. If the volume fraction of water is not very large, the CFA analysis preprocesses the data to compute the volume fraction of water. The data are subsequently processed by the CFA algorithm. The de-coupling of the two steps is mandated by a large magnitude of the water signal and an unknown flow regime of water and oil flowing past the CFA module. Under the assumption that the flow regime is stratified, the uncertainty in the partial density of water can be quantified. The uncertainty can then be propagated to an uncertainty in the corrected optical density representative of the hydrocarbons. The processing is valid independent of the location of the LFA and/or CFA module with respect to the pumpout module.

The systems and methods of the present invention are applicable in a self-consistent manner to a combination of fluid analysis module measurements, such as LFA and CFA measurements, at a station. The techniques of the invention for fluid comparison can be applied to resistivity measurements from the LFA, for example. When the LFA and CFA straddle the pumpout module (as is most often the case), the pumpout module may lead to gravitational segregation of the two fluids, i.e., the fluid in the LFA and the fluid in the CFA. This implies that the CFA and LFA are not assaying the same fluid, making simultaneous interpretation of the two modules challenging. However, both CFA and LFA can be independently used to measure contamination and its uncertainty. The uncertainty can be propagated into magnitude and uncertainty in the fluid properties for each module independently, thus, providing a basis for comparison of fluid properties with respect to each module.

It is necessary to ensure that the difference in fluid properties is not due to a difference in the fluid pressure at the spectroscopy module. This may be done in several ways. A preferred approach to estimating the derivative of optical density with respect to pressure is now described. When a sample bottle is opened, it sets up a pressure transient in the flowline. Consequently, the optical density of the fluid varies in response to the transient. When the magnitude of the pressure transient can be computed from a pressure gauge, the derivative of the OD with respect to the pressure can be computed. The derivative of the OD, in turn, can be used to ensure that the difference in fluid properties of fluids assayed at different points in time is not due to difference in fluid pressure at the spectroscopy module.

Those skilled in the art will appreciate that the magnitude and uncertainty of all fluid parameters described herein are available in closed-form. Thus, there is virtually no computational over-head during data analysis.

Quantification of magnitude and uncertainty of fluid parameters may advantageously provide insight into the nature of the geo-chemical charging process in a hydrocarbon reservoir. For example, the ratio of methane to other hydrocarbons may help distinguish between bio-genic and thermogenic processes.

Those skilled in the art will also appreciate that the above described methods may advantageously be used with conventional methods for identifying compartmentalization, such as observing pressure gradients, performing vertical interference tests across potential permeability barriers, or identifying lithological features that may indicate potential permeability barriers, such as identifying styolites from wireline logs (such as Formation Micro Imager or Elemental Capture Spectroscopy logs).

Figure 5D:
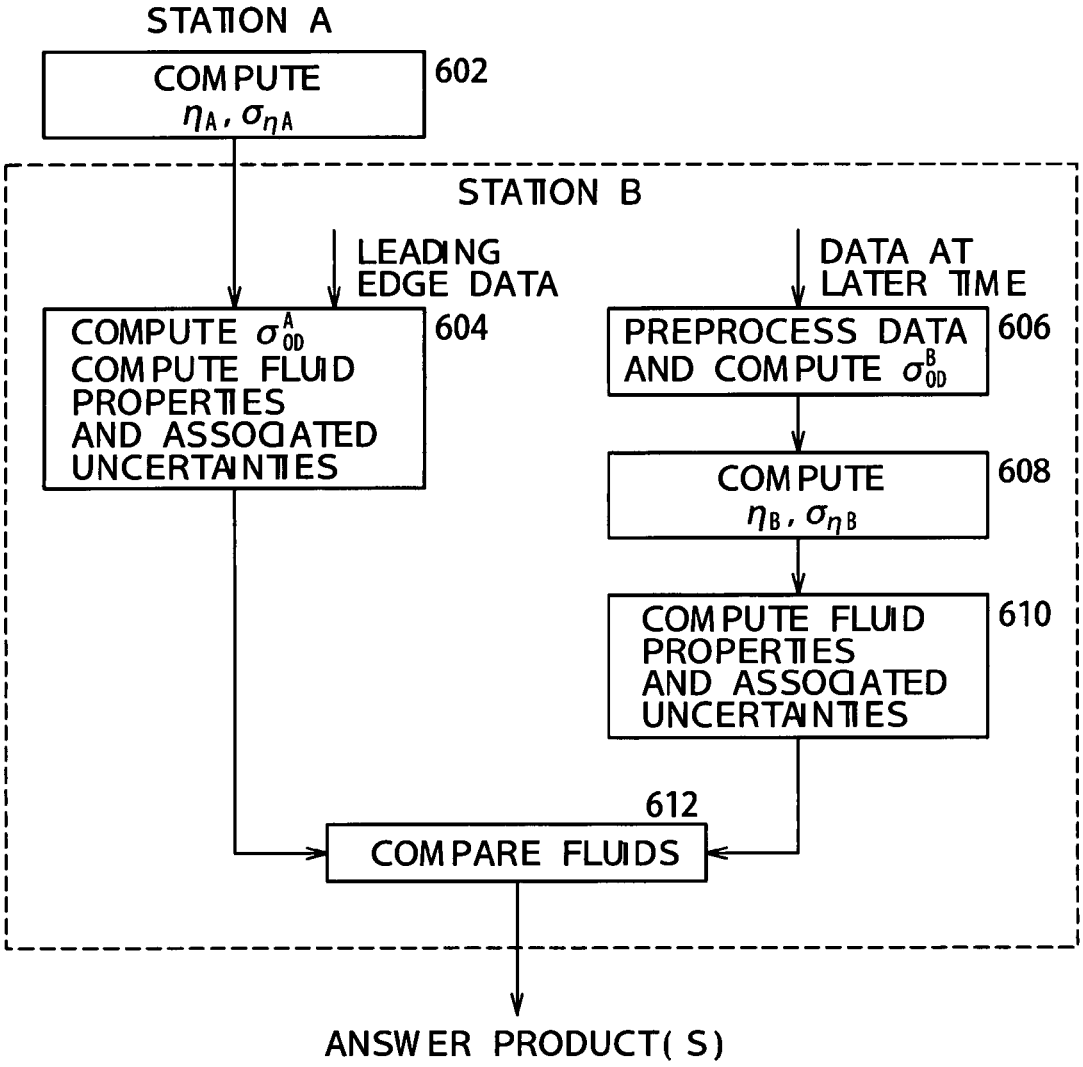
Figure 5E:
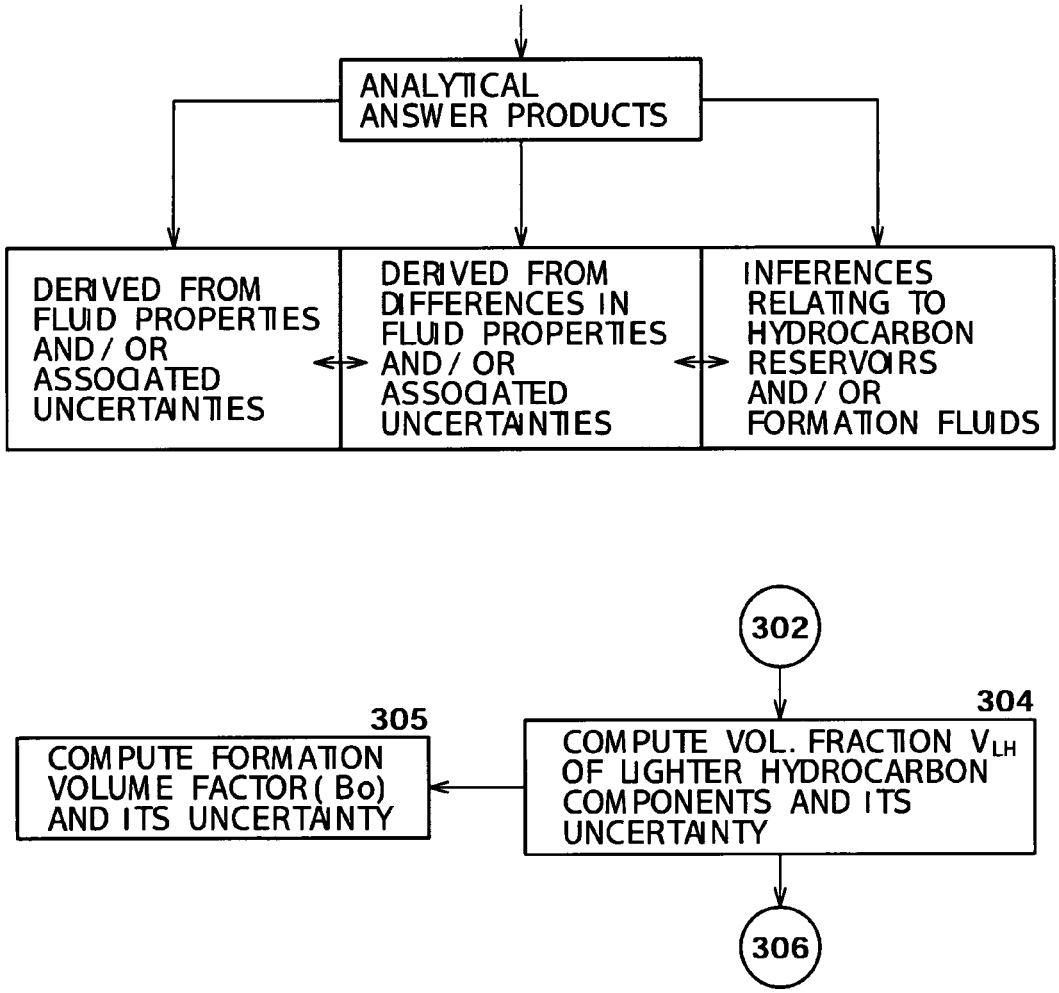

FIG. 5(D) represents in a flowchart a preferred method for comparing formation fluids based on differential fluid properties that are derived from measured data acquired by preferred data acquisition procedures of the present invention. In Step 602, data obtained at Station A, corresponding to fluid A, is processed to compute volumetric contamination $\eta_A$ and its associated uncertainty $\sigma_{\eta A}$. The contamination and its uncertainty can be computed using one of several techniques, such as the oil-base mud contamination monitoring algorithm (OCM). in Equations 1.1 to 1.9 above.

Typically, when a sampling or scanning job by a formation tester tool is deemed complete at Station A, the borehole output valve is opened. The pressure between the inside and outside of the tool is equalized so that tool shock and collapse of the tool is avoided as the tool is moved to the next station. When the borehole output valve is opened, the differential pressure between fluid in the flowline and fluid in the borehole causes a mixing of the two fluids.

Applicants discovered advantageous procedures for accurate and robust comparison of fluid properties of formation fluids using, for example, a formation tester tool, such as the MDT. When the job at Station A is deemed complete, fluid remaining in the flowline is retained in the flowline to be trapped therein as the tool is moved from Station A to another Station B.

Fluid trapping may be achieved in a number of ways. For example, when the fluid analysis module 32 (note FIGS. 2 and 3) is downstream of the pumpout module 38, check valves in the pumpout module 38 may be used to prevent mud entry into the flowline 33. Alternatively, when the fluid analysis module 32 is upstream of the pumpout module 38, the tool 20 with fluid trapped in the flowline 33 may be moved with its borehole output valve closed.

Typically, downhole tools, such as the MDT, are rated to tolerate high differential pressure so that the tools may be moved with the borehole output closed. Alternatively, if the fluid of interest has already been sampled and stored in a sample bottle, the contents of the bottle may be passed through the spectral analyzer of the tool.

FIG. 4, discussed above, also discloses a chamber 40 for trapping and holding formation fluids in the borehole tool 20. Such embodiments of the invention, and others contemplated by the disclosure herein, may advantageously be used for downhole analysis of fluids using a variety of sensors while the fluids are at substantially the same downhole conditions thereby reducing systematic errors in data measured by the sensors.

At Station B, measured data reflect the properties of both fluids A and B. The data may be considered in two successive time windows. In an initial time window, the measured data corresponds to fluid A as fluid trapped in the flowline from Station A flows past the spectroscopy module of the tool. In other preferred embodiments of the invention, fluid A may be flowed past a sensor of the tool from other suitable sources. The later time window corresponds to fluid B drawn at Station B or, in alternative embodiments of the invention, from other sources of fluid B. Thus, the properties of the two fluids A and B are measured at the same external conditions, such as pressure and temperature, and at almost the same time by the same hardware. This enables a quick and robust estimate of difference in fluid properties.

Since there is no further contamination of fluid A, the fluid properties of fluid A remain constant in the initial time window. Using the property that in this time window the fluid properties are invariant, the data may be pre-processed to estimate the standard deviation of noise $\sigma_{OD}{}^{A}$ in the measurement (Step 604). In conjunction with contamination from Station A (derived in Step 602), the data may be used to predict fluid properties, such as live fluid color, GOR and dead-crude spectrum, corresponding to fluid A (Step 604), using the techniques previously described above. In addition, using the OCM algorithm in Equations 1.1 to 1.9 above, the uncertainty in the measurement $\sigma_{OD}{}^{A}$ (derived in Step 604) may be coupled together with the uncertainty in contamination $\sigma_{72\ A}$ (derived in Step 602) to compute the uncertainties in the predicted fluid properties (Step 604).

The later time window corresponds to fluid B as it flows past the spectroscopy module. The data may be pre-processed to estimate the noise in the measurement $\sigma_{OD}{}^{B}$ (Step 606). The contamination $\eta_B$ and its uncertainty $\sigma_{\eta B}$ may be quantified using, for example, the OCM algorithm in Equations 1.1 to 1.9 above (Step 608). The data may then be analyzed using the previously described techniques to quantify the fluid properties and associated uncertainties corresponding to fluid B (Step 610).

In addition to quantifying uncertainty in the measured data and contamination, the uncertainty in fluid properties may also be determined by systematically pressurizing formation fluids in the flowline. Analyzing variations of fluid properties with pressure provides a degree of confidence about the predicted fluid properties. Once the fluid properties and associated uncertainties are quantified, the two fluids' properties may be compared in a statistical framework using Equation 1.12 above (Step 612). The differential fluid properties are then obtained as a difference of the fluid properties that are quantified for the two fluids using above-described techniques.

In the process of moving a downhole analysis and sampling tool to a different station, it is possible that density difference between OBM filtrate and reservoir fluid could cause gravitational segregation in the fluid that is retained in the flowline, or otherwise trapped or captured for fluid characterization. In this case, the placement of the fluid analysis module at the next station can be based on the type of reservoir fluid that is being sampled. For example, the fluid analyzer may be placed at the top or bottom of the tool string depending on whether the filtrate is lighter or heavier than the reservoir fluid.

EXAMPLE

Figure 15:
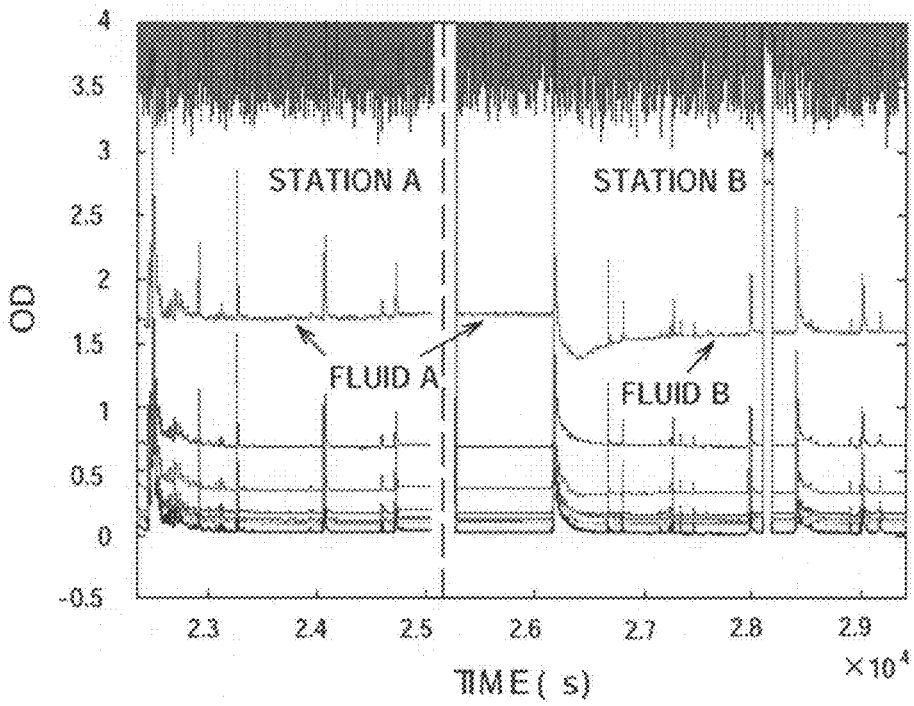
FIG. 15 is a graphical representation of optical density data from Station A, corresponding to fluid A, and data from Station B, corresponding to fluids A and B.

FIG. 15 shows a field data set obtained from a spectroscopy module (LFA) placed downstream of the pumpout module. The check-valves in the pumpout module were closed as the tool was moved from Station A to Station B, thus trapping and moving fluid A in the flowline from one station to the other. The initial part of the data until t=25500 seconds corresponds to fluid A at Station A. The second part of the data after time t=25500 seconds is from Station B.

At Station B, the leading edge of the data from time 25600-26100 seconds corresponds to fluid A and the rest of the data corresponds to fluid B. The different traces correspond to the data from different channels. The first two channels have a large OD and are saturated. The remaining channels provide information about color, composition, GOR and contamination of the fluids A and B.

Figure 16:
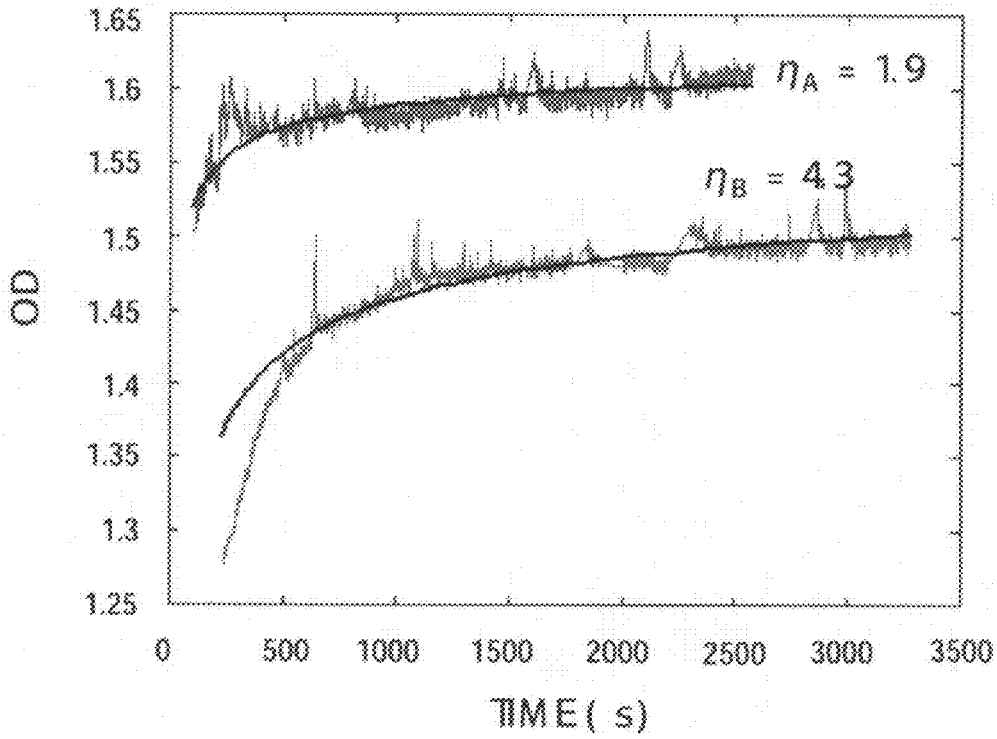
FIG. 16 represents in a graph data from the color channel for fluid A (blue) and fluid B (red) measured at Stations A and B, respectively (note also FIG. 15). The black line is the fit by the oil-base mud contamination monitoring (OCM) algorithm to the measured data. At the end of pumping, the contamination level of fluid A was 1.9% and of fluid B was 4.3%.

Computations of difference in fluid properties and associated uncertainty include the following steps:

Step 1: The volumetric contamination corresponding to fluid A is computed at Station A. This can be done in a number of ways. FIG. 16 shows a color channel (blue trace) and model fit (black trace) by the OCM used to predict contamination. At the end of the pumping process, the contamination was determined to be 1.9% with an uncertainty of about 3%.

Figure 17A:
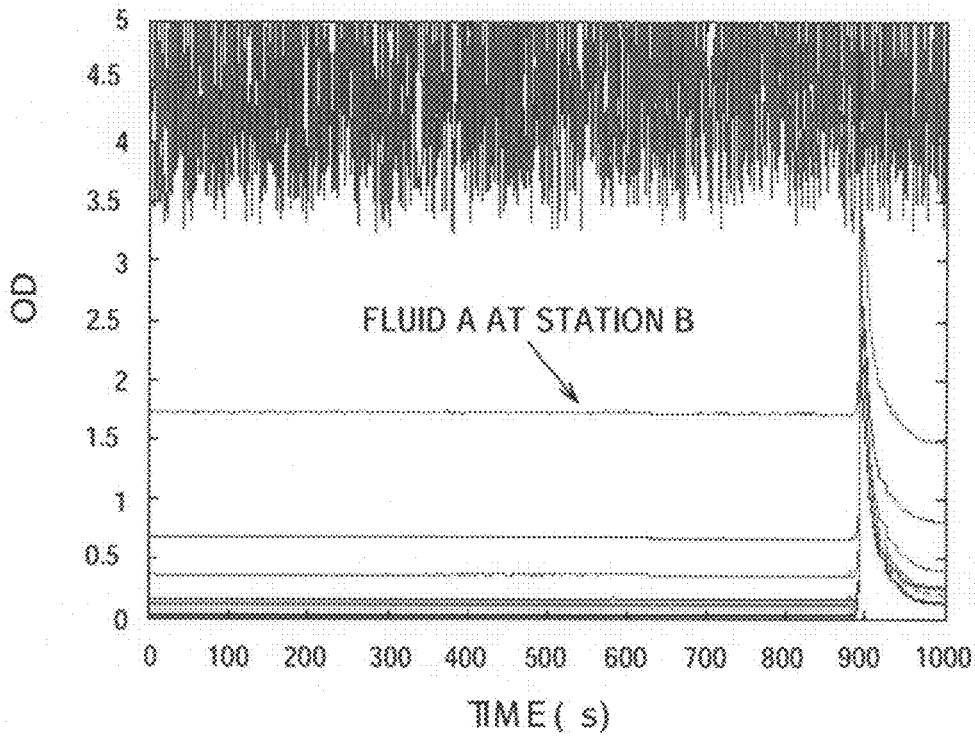
FIG. 17(A) graphically depicts the leading edge of data at Station B corresponding to fluid A and FIG. 17(B), which graphically depicts the leading edge of data for one of the channels at Station B, shows that the measured optical density is almost constant (within noise range in the measurement).
Figure 17B:
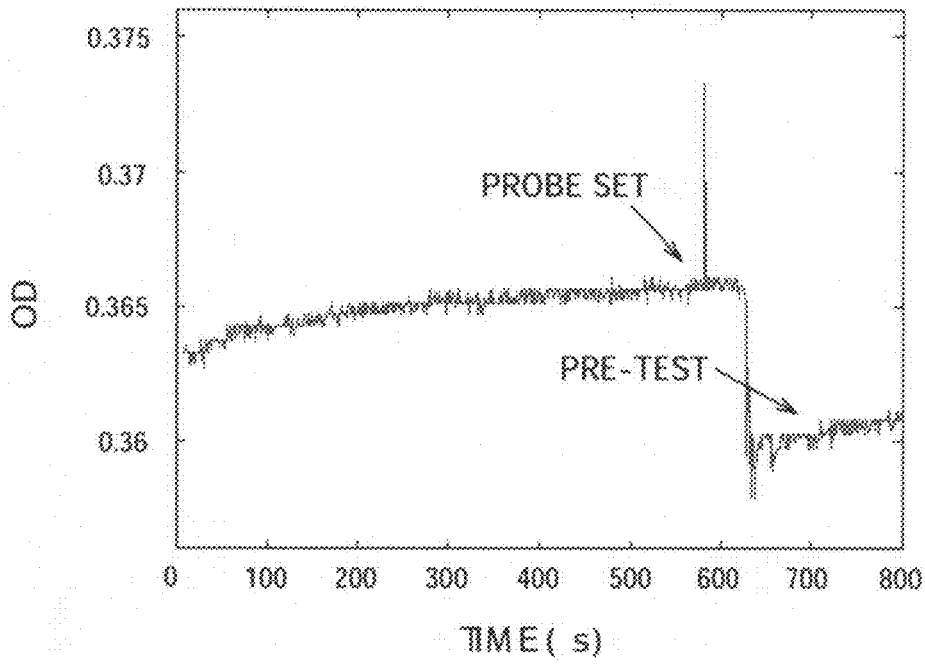

Step 2: The leading edge of the data at Station B corresponding to fluid A is shown in FIG. 17(A). The measured data for one of the channels in this time frame is shown in FIG. 17(B). Since there is no further contamination of fluid A, the fluid properties do not change with time. Thus, the measured optical density is almost constant. The data was analyzed to yield a noise standard deviation $\sigma OD^A$ of around 0.003 OD. The events corresponding to setting of the probe and pre-test, seen in the data in FIG. 17(B), were not considered in the computation of the noise statistics.

Using the contamination and its uncertainty from Step 1, above, and $\sigma_{OD}{}^A$=0.003 OD, the live fluid color and dead-crude spectrum and associated uncertainties are computed for fluid A by the equations previously described above. The results are graphically shown by the blue traces in FIGS. 18 and 19, respectively.

Step 3: The second section of the data at Station B corresponds to fluid B. FIG. 16 shows a color channel (red trace) and model fit (black trace) by the OCM used to predict contamination. At the end of the pumping process, the contamination was determined to be 4.3% with an uncertainty of about 3%. The predicted live fluid color and dead-crude spectrum for fluid B, computed as previously described above, are shown by red traces in FIGS. 18 and 19.

Figure 18:
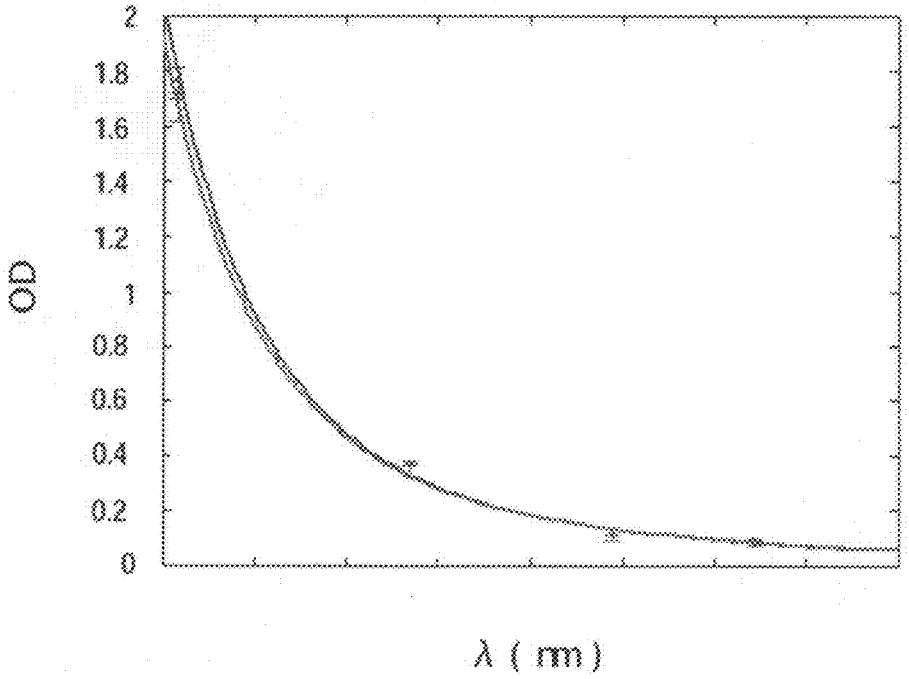
FIG. 18, a graphic comparison of live fluid colors, shows that the two fluids A and B cannot be distinguished based on color.
Figure 19:
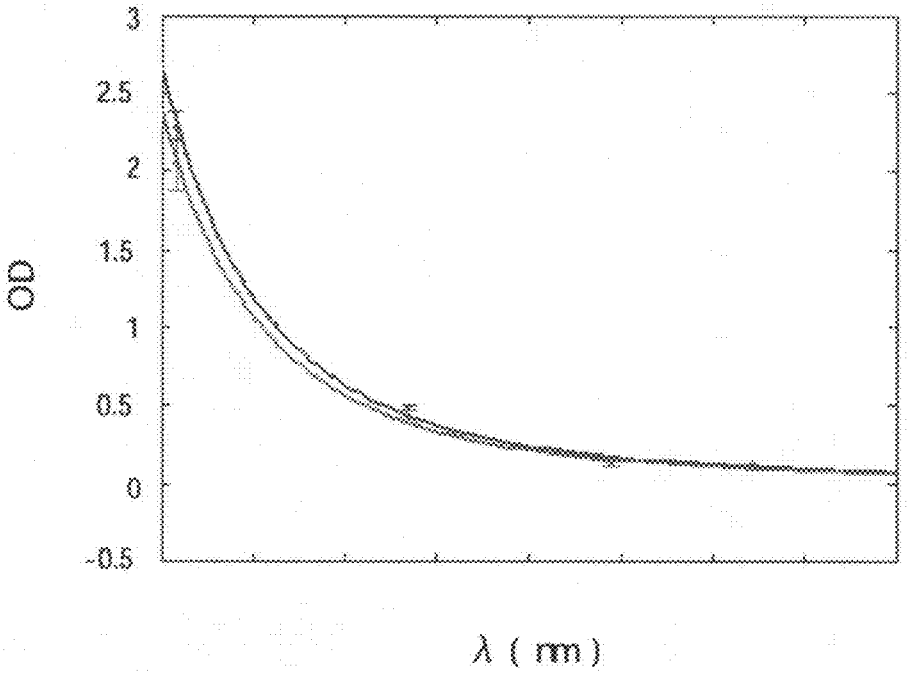
FIG. 19, a graphic comparison of dead-crude spectra, shows that the two fluids A and B are indistinguishable in terms of dead-crude color.

The noise standard deviation computed by low-pass filtering the data and estimating the standard deviation of the high-frequency component is $\sigma_{OD}{}^B$=0.005 OD. The uncertainty in the noise and contamination is reflected as uncertainty in the predicted live fluid color and dead-crude spectrum (red traces) for fluid B in FIGS. 18 and 19, respectively. As shown in FIGS. 18 and 19, the live and dead-crude spectra of the two fluids A and B overlap and cannot be distinguished between the two fluids.

In addition to the live fluid color and dead-crude spectrum, the GORs and associated uncertainties of the two fluids A and B were computed using the equations previously discussed above. The GOR of fluid A in the flowline is 392±16 scf/stb. With a contamination of 1.9%, the contamination-free GOR is 400±20 scf/stb. The GOR of fluid B in the flowline is 297±20 scf/stb. With contamination of 4.3%, the contamination-free GOR is 310±23 scf/stb. Thus, the differential GOR between the two fluids is significant and the probability that the two fluids A and B are different is close to 1.

In contrast, ignoring the leading edge of the data at Station B and comparing fluids A and B directly from Stations A and B produces large uncertainty in the measurement. In this case, $\sigma_{OD}{}^A$ and $\sigma_{OD}{}^B$ would capture both systematic and random errors in the measurement and, therefore, would be considerably larger. For example, when $\sigma_{OD}{}^A$=$\sigma_{OD}{}^B$=0.01 OD, the probability that the two fluids A and B are different in terms of GOR is 0.5. This implies that the differential GOR is not significant. In other words, the two fluids A and B cannot be distinguished in terms of GOR.

The methods of the present invention provide accurate and robust measurements of differential fluid properties in real-time. The systems and methods of the present invention for determining difference in fluid properties of formation fluids of interest are useful and cost-effective tools to identify compartmentalization and composition gradients in hydrocarbon reservoirs.

The methods of the present invention include analyzing measured data and computing fluid properties of two fluids, for example, fluids A and B, obtained at two corresponding Stations A and B, respectively. At Station A, the contamination of fluid A and its uncertainty are quantified using an algorithm discussed above. In one embodiment of the invention, formation fluid in the flowline may be trapped therein while the tool is moved to Station B, where fluid B is pumped through the flowline. Data measured at Station B has a unique, advantageous property, which enables improved measurement of difference in fluid properties. In this, leading edge of the data corresponds to fluid A and the later section of the data corresponds to fluid B. Thus, measured data at the same station, i.e., Station B, reflects fluid properties of both fluids A and B. Differential fluid properties thus obtained are robust and accurate measures of the differences between the two fluids and are less sensitive to systematic errors in the measurements than other conventional fluid sampling and analysis techniques. Advantageously, the methods of the present invention may be extended to multiple fluid sampling stations and other regimes for flowing two or more fluids through a flowline of a fluid characterization apparatus so as to be in communication, at substantially the same downhole conditions, with one or more sensors associated with the flowline.

The methods of the invention may advantageously be used to determine any difference in fluid properties obtained from a variety of sensor devices, such as density, viscosity, composition, contamination, fluorescence, amounts of $H_2S$ and $CO_2$, isotopic ratios and methane-ethane ratios. The algorithmic-based techniques disclosed herein are readily generalizable to multiple stations and comparison of multiple fluids at a single station.

Applicants recognized that the systems and methods disclosed herein enable real-time decision making to identify compartmentalization and/or composition gradients in reservoirs, among other characteristics of interest in regards to hydrocarbon formations.

Applicants also recognized that the systems and methods disclosed herein would aid in optimizing the sampling process that is used to confirm or disprove predictions, such as gradients in the reservoir, which, in turn, would help to optimize the process by capturing the most representative reservoir fluid samples.

Applicants further recognized that the systems and methods disclosed herein would help to identify how hydrocarbons of interest in a reservoir are being swept by encroaching fluids, for example, water or gas injected into the reservoir, and/or would provide advantageous data as to whether a hydrocarbon reservoir is being depleted in a uniform or compartmentalized manner.

Applicants also recognized that the systems and methods disclosed herein would potentially provide a better understanding about the nature of the geo-chemical charging process in a reservoir.

Applicants further recognized that the systems and methods disclosed herein could potentially guide next-generation analysis and hardware to reduce uncertainty in predicted fluid properties. In consequence, risk involved with decision making that relates to oilfield exploration and development could be reduced.

Applicants further recognized that in a reservoir assumed to be continuous, some variations in fluid properties are expected with depth according to the reservoir's compositional grading. The variations are caused by a number of factors such as thermal and pressure gradients and bio-degradation. A quantification of difference in fluid properties can help provide insight into the nature and origin of the composition gradients.

Applicants also recognized that the modeling techniques and systems of the invention would be applicable in a self-consistent manner to spectroscopic data from different downhole fluid analysis modules, such as Schlumberger's CFA and/or LFA.

Applicants also recognized that the modeling methods and systems of the invention would have applications with formation fluids contaminated with oil-base mud (OBM), water-base mud (WBM) or synthetic oil-base mud (SBM).

Applicants further recognized that the modeling frameworks described herein would have applicability to comparison of a wide range of fluid properties, for example, live fluid color, dead crude density, dead crude spectrum, GOR, fluorescence, formation volume factor, density, viscosity, compressibility, hydrocarbon composition, isotropic ratios, methane-ethane ratios, amounts of $H_2S$ and $CO_2$, among others, and phase envelope, for example, bubble point, dew point, asphaltene onset, pH, among others.

The preceding description has been presented only to illustrate and describe the invention and some examples of its implementation. It is not intended to be exhaustive or to limit the invention to any precise form disclosed. Many modifications and variations are possible in light of the above teaching.

The preferred aspects were chosen and described in order to best explain principles of the invention and its practical applications. The preceding description is intended to enable others skilled in the art to best utilize the invention in various embodiments and aspects and with various modifications as are suited to the particular use contemplated. It is intended that the scope of the invention be defined by the following claims.

What is claimed is:

1. A method of deriving fluid properties of downhole fluids from downhole measurements, the method comprising:

acquiring a first fluid at a first station in a borehole;

trapping the first fluid in a device;

acquiring a second fluid at a second station in the borehole; and at substantially the same downhole conditions, analyzing the first and second fluid with the device in the borehole to derive fluid property data for the first and second fluid;

wherein the fluid property data for the first and second fluid is stored;

deriving respective fluid properties of the fluids based on the fluid property data for the first and second fluid; and quantifying uncertainty in the derived fluid properties.

2. The method of claim 1 further comprising:

comparing the fluids based on the derived fluid properties and uncertainty in fluid properties.

3. The method of claim 2, wherein the fluid properties are one or more of live fluid color, dead crude density, GOR and fluorescence.

4. The method of claim 2 further comprising:

providing answer products comprising sampling optimization by the borehole device based on the respective fluid properties derived for the fluids.

5. The method of claim 1, wherein the fluid property data comprise optical density from one or more spectroscopic channels of the device in the borehole;

the method further comprising:

receiving uncertainty data with respect to the optical density data.

6. The method of claim 1 further comprising:

locating the device in the borehole at a position based on a fluid property of the fluids.

7. The method of claim 1 further comprising:

quantifying a level of contamination and uncertainty thereof for each of the at least two fluids.

8. The method of claim 1 further comprising:

providing answer products, based on the fluid property data, comprising one or more of compartmentalization, composition gradients and optimal sampling process with respect to evaluation and testing of a geologic formation.

9. The method of claim 1 further comprising:

decoloring the fluid property data;

determining respective compositions of the fluids;

deriving volume fraction of light hydrocarbons for each of the fluids; and providing formation volume factor for each of the fluids.

10. The method of claim 1, wherein the fluid property data for each fluid are received from a methane channel and a color channel of a downhole spectral analyzer.

11. The method of claim 10 further comprising:

quantifying a level of contamination and uncertainty thereof for each of the channels for each fluid.

12. The method of claim 11 further comprising:

obtaining a linear combination of the levels of contamination for the channels and uncertainty with respect to the combined level of contamination for each fluid.

13. The method of claim 12 further comprising:

determining composition of each fluid;

predicting GOR for each fluid based upon the corresponding composition of each fluid and the combined level of contamination; and deriving uncertainty associated with the predicted GOR of each fluid.

14. The method of claim 13 further comprising:

comparing the fluids based on the predicted GOR and derived uncertainty of each fluid.

15. The method of claim 14, wherein comparing the fluids comprises determining probability that the fluids are different.

16. The method of claim 1, wherein acquiring at least the first and the second fluid comprises acquiring at least one of the first and the second fluid from an earth formation traversed by the borehole.

17. The method of claim 1, wherein acquiring at least the first and the second fluid comprises acquiring at least one of the first and the second fluid from a first source and another one of the first and second fluid from a different second source.

18. The method of claim 17, wherein the first and second source comprise different locations of an earth formation traversed by the borehole.

19. The method of claim 17, wherein at least one of the first and second source comprises a stored fluid.

20. The method of claim 17, wherein the first and second source comprise fluids acquired at different times at a same location of an earth formation traversed by the borehole.

21. A method of reducing systematic errors in downhole data, the method comprising:

obtaining a sample of a first fluid;

obtaining a sample of a second fluid;

acquiring downhole data sequentially for at least the first and the second fluid at substantially the same downhole conditions with a device in a borehole;

deriving respective fluid properties of the first and second fluids based on the downhole data for the first and second fluid;

storing the derived fluid properties; and quantifying uncertainty in the derived fluid properties.

22. A downhole fluid characterization apparatus, comprising:

a fluid analysis module, the fluid analysis module comprising:

a flowline for fluids withdrawn from a formation to flow through the fluid analysis module;

a selectively operable device structured and arranged with respect to the flowline for flowing and trapping at least a first and a second fluid through the fluid analysis module; and at least one sensor associated with the fluid analysis module for generating fluid property data for the first and second fluid at substantially the same downhole conditions, and quantifying uncertainty in fluid properties.

23. The apparatus of claim 22, wherein the selectively operable device comprises at least one valve associated with the flowline.

24. The apparatus of claim 23, wherein the valve comprises one or more of check valves in a pumpout module and a borehole output valve associated with the flowline.

25. The apparatus of claim 22, wherein the selectively operable device comprises a device with multiple storage containers for selectively storing and discharging fluids withdrawn from the formation.

26. A system for characterizing formation fluids and providing answer products based upon the characterization, the system comprising:

a borehole tool including:

a flowline with an optical cell, a selectively operable device associated with the flowline for flowing and trapping at least a first and a second fluid through the optical cell, and a fluid analyzer optically coupled to the cell and configured to produce fluid property data with respect to the first and second fluid flowing through the cell; and at least one processor, coupled to the borehole tool, comprising:

means for receiving fluid property data from the borehole tool, wherein the fluid property data are generated with the first and second fluid at substantially the same downhole conditions, the processor being configured to derive respective fluid properties of the first and second fluid based on the fluid property data, and to quantify uncertainty in the derived fluid properties.

27. A computer usable medium having computer readable program code thereon, which when executed by a computer, adapted for use with a borehole system for characterizing downhole fluids, comprises:

receiving fluid property data for at least a first and a second downhole fluid, wherein the fluid property data of the first and second fluid are generated with a device in a borehole at substantially the same downhole conditions;

calculating respective fluid properties of the fluids based on the received data;

storing the respective fluid properties; and quantifying uncertainty in the derived fluid properties.

* * * * *